US005104776A

United States Patent [19]

Bagchi et al.

[11] Patent Number: 5,104,776

[45] Date of Patent: Apr. 14, 1992

[54] INCREASED PHOTOGRAPHIC ACTIVITY PRECIPITATED COUPLER DISPERSIONS PREPARED BY COPRECIPITATION WITH LIQUID CARBOXYLIC ACIDS

[75] Inventors: Pranab Bagchi, Webster; Steven J. Sargeant, Honeoye Falls, both of N.Y.

[73] Assignee: Eastman Kodak Company, Rochester, N.Y.

[21] Appl. No.: 442,827

[22] Filed: Nov. 29, 1989

[51] Int. Cl.[5] ..... G03C 5/26

[52] U.S. Cl. ..... 430/449; 430/546; 430/569; 430/635

[58] Field of Search ..... 430/569, 546, 635, 449

[56] References Cited

U.S. PATENT DOCUMENTS

| | | | |
|---|---|---|---|
| 2,343,051 | 2/1944 | Frohlich et al. | 95/7 |
| 3,133,816 | 5/1964 | Ben-Ezra | 430/635 |
| 3,271,152 | 9/1966 | Hauson, Jr. | 96/56.5 |
| 3,658,546 | 4/1972 | Van Doorselaer et al. | 430/546 |
| 3,676,142 | 7/1972 | Carpentier et al. | 96/100 |
| 3,912,517 | 10/1975 | Van Poucke | 96/100 |
| 3,936,303 | 2/1976 | Shiba et al. | 96/74 |
| 4,957,857 | 9/1990 | Chari | 430/546 |
| 4,970,139 | 11/1990 | Bagchi | 430/449 |

FOREIGN PATENT DOCUMENTS

| | | |
|---|---|---|
| 6230251 | of 1985 | Japan . |
| 6227737 | 7/1985 | Japan . |
| 6227738 | 7/1985 | Japan . |
| 6227739 | 7/1985 | Japan . |
| 6385547 | 9/1986 | Japan . |
| 6385629 | 9/1986 | Japan . |
| 6385630 | 9/1986 | Japan . |
| 6385632 | 9/1986 | Japan . |
| 6385633 | 9/1986 | Japan . |
| 1077426 | 7/1967 | United Kingdom . |

*Primary Examiner*—Charles L. Bowers, Jr.
*Assistant Examiner*—Janet C. Baxter
*Attorney, Agent, or Firm*—Paul A. Leipold

[57] ABSTRACT

Base and auxiliary solvent solubilized precipitated dispersions of couplers and other photographic materials usually produce very small particle dispersions, and usually such dispersions are extremely highly reactive because of the smallness of the particle size. However, some relatively more hydrophobic couplers, even though they produce small particles when a dispersion is formed by the precipitation technique, lead to extremely unreactive dispersions. The method of this invention constitutes a single step coprecipitation technique where a base deprotonation compound, preferably a liquid carboxylic acid, is incorporated into the precipitated particles to produce photographically highly active coupler dispersions. The invention is performed by providing a first flow of an aqueous surfactant solution and a second flow comprising a basic solution of the coupler and the base deprotonable compound in a water miscible volatile auxiliary solvent and mixing the said first and second streams either simultaneously or immediately following thereof, neutralizing said streams with an acid solution. Such immediate neutralization protects any hydrolizable surfactants that may be utilized in the crude emulsion stream. In a preferred method, the first and the second stream may be brought together immediately prior to neutralization or directly into a mixer with addition of acid directly into the mixer to neutralize the dispersion to form a dispersion of fine particles.

23 Claims, 6 Drawing Sheets

INCREASED PHOTOGRAPHIC ACTIVITY PRECIPITATED COUPLER DISPERSIONS PREPARED BY COPRECIPITATION WITH LIQUID CARBOXYLIC ACIDS

FIELD OF THE INVENTION

This invention relates to the formation of dispersions of photographic materials by precipitation from solution by shift of pH. It particularly relates to the coprecipitation of the coupler along with a liquid carboxylic acid to produce a highly active photographic coupler dispersion.

PRIOR ART

It has been known in the photographic arts to precipitate photographic materials, such as couplers, from solvent solution. The precipitation of such materials can generally be accomplished by a shift in the content of a water miscible solvent and/or a shift in pH. The precipitation by a shift in the content of water miscible solvent is normally accomplished by the addition of an excess of water to a solvent solution. The excess of water, in which the photographic component is insoluble, will cause precipitation of the photographic component as small particles. In precipitation by pH shift, a photographic component is dissolved in a solvent that is either acidic or basic. The pH is then shifted such that acidic solutions are made basic or basic solutions are made acidic in order to precipitate particles of the photographic component which is insoluble at that pH.

United Kingdom Patent 1,193,349-Townsley et al discloses a process wherein an organic solvent, aqueous alkali solution of a color coupler is mixed with an aqueous acid medium to precipitate the color coupler. It is set forth that the materials can either be utilized immediately, or gelatin can be added to the dispersion and chilled and remelted for use at a later date.

In an article in *Research Disclosure*, December, 1977, entitled "Process for Preparing Stable Aqueous Dispersions of Certain Hydrophobic Materials", pages 75–80, by William J. Priest, it is disclosed that color couplers can be formed by precipitation of small particles from solutions of the couplers in organic auxiliary solvents.

Such precipitated dispersion particle formation processes have been successful in forming laboratory quantities of photographic materials. It is not believed that such dispersion particle formation of photographic materials has been successfully scaled up for commercial utilization. One difficulty with scaling up for commercial utilization is that the large quantities required do not successfully lend themselves to the batch techniques utilized in laboratory formation. A continuous technique would be desirable. Certain surfactants are potent in the formulation of such dispersions, but contain chemical linkages that are hydrolyzed by base in the high pH solution of the coupler. This causes problems with scaling up, in both batch and continuous processes where considerable loss of the surfactant by hydrolysis is encountered. This problem is particularly severe in commercial or large volume production where, because of the large volumes involved, the time of wait before neutralization of the micellar solution is very long (greater than ½ to 2 hours). The micellar solution is the basic coupler solution mixed with the aqueous surfactant solution, at highly alkaline pH, prior to neutralizing with acid. When the surfactant hydrolyzes, the particles from lack of enough stabilizer form larger particles that are, in many cases, less reactive and therefore undesirable. Time required in equipment preparation in pilot scale or full-scale manufacturing may make it necessary for such solutions to sit for periods of time up to several hours. It is necessary to adjust the pH of the basic coupler containing solution to slightly acid (about pH 6) to effect the formation of the dispersion. The addition of the neutralizing acid to large volumes of material cannot be performed rapidly enough to prevent formation of large particulate dispersions. If the micellar solution remains at high pH for a long enough time, such hydrolyzable surfactants undergo extensive hydrolysis and cause the formation of large particles, due to lack of stabilizing surfactant, prior to neutralization with acid. Therefore, the particle sizes will not be uniform from batch to batch, as they will vary depending on how long the micellar solution was formed prior to utilization or neutralization. It will be necessary to discard large quantities of coupler dispersion that will not meet manufacturing specifications. It has been proposed in copending co-assigned U.S. Ser. No. 297,005 filed Jan. 17, 1989 that uniform small particle size coupler dispersions may be made by the process in which the particles are simultaneously formed and neutralized. While the process allows the formation of uniform, stable particles, it has been found that some of the coupler materials unexpectedly form particles that are not as photographically active as would be desirable. It had been assumed that small particles would unfailingly be more active than large particles. Therefore, there remains a need for a process that will allow the formation of such continuously precipitated dispersions of coupler materials that have adequate photographic activity.

In conventional photographic systems it has been the practice to mill polymer and/or gelatin, surfactant, and couplers with a mixture of solvents. The solvents consist of a permanent non-water soluble solvent normally having a high boiling temperature and sometimes a water miscible auxiliary solvent that is usually removed during film formation or removed by washing off from chilled gel noodles, or is distilled off. The coupler dissolved in the permanent solvent remains dispersed as a stable colloid in gelatin which is used in forming photographic products. Typical of such systems for polymeric couplers are those disclosed in U.S. Pat. No. 3,912,517—Van Poucke et al. The dispersion of couplers and solvents is also discussed at pages 348–351 of The Theory of Photographic Process, Fourth Edition, edited by T. H. James, MacMillan, New York, Copyright 1977.

In the field of conventional milled photographic dispersions, Japanese Application 63/85633 from Fuji Photo Film Co., Ltd. describes the use of gelatin dispersed organic carboxylic acids in photographic elements. Similarly, preparation of milled dispersions containing gelatin, coupler, and wax-like saturated and unbranched fatty acids are described in U.S. Pat. No. 3,676,192 and of various organic fatty oils in U.S. Pat. No. 3,936,303.

While the above processes for making photographic materials have been somewhat successful, there is a continuing need for preparing them in a continuous mode for efficient process control in the production of very large volume products, such as photographic paper and motion picture print films. Further, there is a need for methods of dispersion particle formation in which the particles have high photo activity.

THE INVENTION

Generally the invention is performed by providing a first flow of water and surfactant and a second flow comprising a water miscible auxiliary solvent, base, a liquid carboxylic acid compound, and the photographic coupler material, bringing together the said first and the said second flows and then either simultaneously or immediately following mixing, neutralizing the said streams to precipitate the dispersion particles. The precipitated particles contain the activating protonated form of the liquid carboxylic acids. Such particles are generally more active than precipitated dispersions that have no coprecipitated liquid carboxylic acids. During this coprecipitation process, using the ionized liquid carboxylic acids the liquid carboxylic acids get incorporated in the coupler particles to produce small particle dispersions of diameters between about 30 and about 200 nm depending upon the nature of the coupler and the acid used.

MODES OF PERFORMING THE INVENTION

Figure 1:
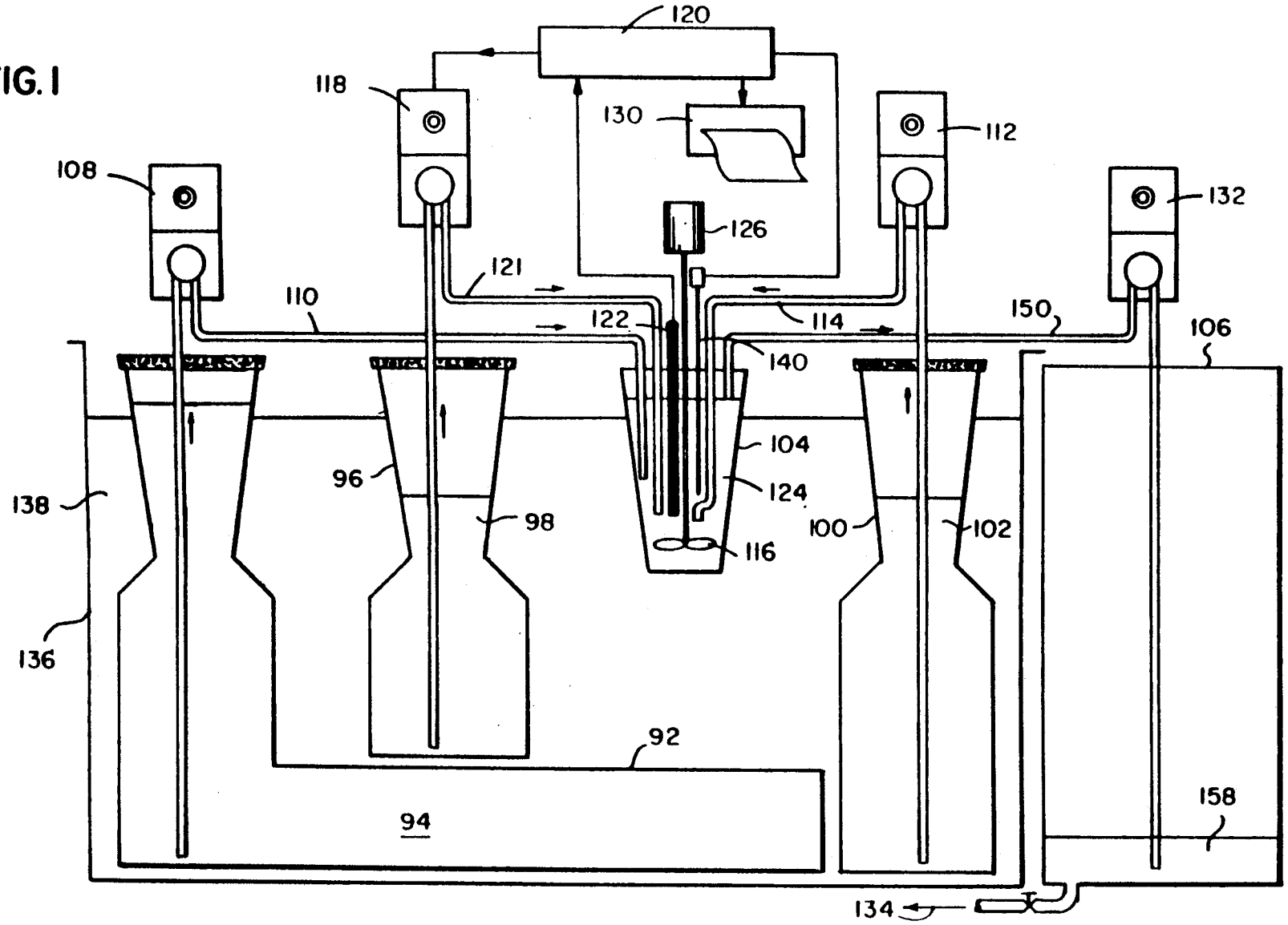
FIG. 1 illustrates schematically the small scale device for the preparation of the dispersions of this invention in a continuous mode.

The invention provides numerous advantages over prior processes of forming dispersions of photographic components. The invention provides continuous or semicontinuous methods of forming highly photographically active dispersions of couplers. Even though procedures for the preparation of precipitated coupler dispersions have been known, the method increasing photographic activity by incorporating liquid carboxylic acids by coprecipitation, in a single step, during their formulation was unknown. Some precipitated coupler dispersions such as formed by the above-referenced U.S. Ser. No. 297,005—Bagchi et al filed Jan. 17, 1989, and hereby incorporated by reference do not have high photographic activity. It was discovered that the coprecipitation of liquid carboxylic acids during precipitation in the manner of this invention produced coupler dispersion of desirable and high photographic activity. Methods have been discovered in which liquid carboxylic acids can be incorporated in precipitated dispersion during its formation in a single step. Such liquid carboxylic acid-containing dispersions have been found to be much more active than the precipitated dispersions that did not contain any additives. The activity of such dispersions are more than adequate for formation of photographic products. Since these liquid carboxylic acid-containing precipitated dispersions do not contain gelatin, they can be held at room temperature until photographic coatings are made. This is a cost saving advantage over conventional milled dispersions that contain gelatin, which need to be refrigerated.

The formed dispersions are stable, do not contain gelatin, and can be washed by dialysis or by diafiltration to remove the water miscible auxiliary solvent to produce a photographic dispersion containing the coupler and the liquid carboxylic acids. It is held for further processing to produce photographic coatings at a later time.

The invention is practiced in a semicontinuous mode by bringing a first flow of coupler and carboxylic acid solution in basic aqueous-auxiliary solvent into a vessel containing an aqueous surfactant solution, and immediately neutralizing it with an acid solution, with vigorous agitation. The reaction vessel is fitted with a temperature sensor and a pH sensor which senses the pH and drives the acid pump such that for a constant rate of delivery of the basic coupler solution, the correct amount of acid is always pumped in by a processor controlled pump to maintain a constant pH of $6.0 \pm 0.2$ in the reactor. In a continous mode this invention can be practiced by having a third flow of the surfactant containing crude dispersion of the permanent solvent flow into the reactor at a pre-set rate. The dispersion is then dialyzed to remove the auxiliary solvent and processed for photographic use when necessary.

In preferred methods, for large scale preparation, the first stream of coupler and carboxylic acid solution in basic aqueous-auxiliary solvent, and the second stream of the aqueous surfactant may be brought together immediately prior to a centrifugal mixer with addition of acid directly into the mixer. In the alternative, the first and second flow, as well as the acid flow, may all be added simultaneously in the centrifugal mixer. The streams will have a residence time of about 1 to about 30 seconds in the mixer. When leaving the mixer, they may be diafiltered on line to remove the auxiliary solvent and immediately be processed for utilization in photographic materials. When the process is stopped, the mixer may be shut off with minimum waste of material, as it is only necessary to discard the material in the mixer and pipelines immediately adjacent to it when the process is reactivated after a lengthy shutdown.

In all the described procedures of practicing this invention the surfactant containing crude dispersion of the carboxylic acid is in contact with the high pH environment of the coupler solution for a minimum period of time. Since pH neutralization is very rapid, the surfactant experiences a high pH environment for very short times. There are many surfactants that are excellent stabilizers for precipitated dispersions. However, some of them contain a chemical linkage such as an ester linkage that gets easily hydrolyzed by the base, causing the loss of the stabilizing ability of the surfactant. Utilization of the process of mixing with immediate neutralization by acid virtually eliminates the chance of hydrolysis of such hydrolyzable surfactants, which leads to cost savings in the need for less surfactant.

The process of the invention produces particles of coupler that are present in water without gelatin. The gelatin free suspensions of the invention are stable in storage and may be stored at room temperature rather than chilled as are gelatin suspensions. The particles generally have a particle size of about 5 to about 300 nm and preferably between about 30 and 200 nm depending upon the nature of the coupler and the acid used.

Figure 2:
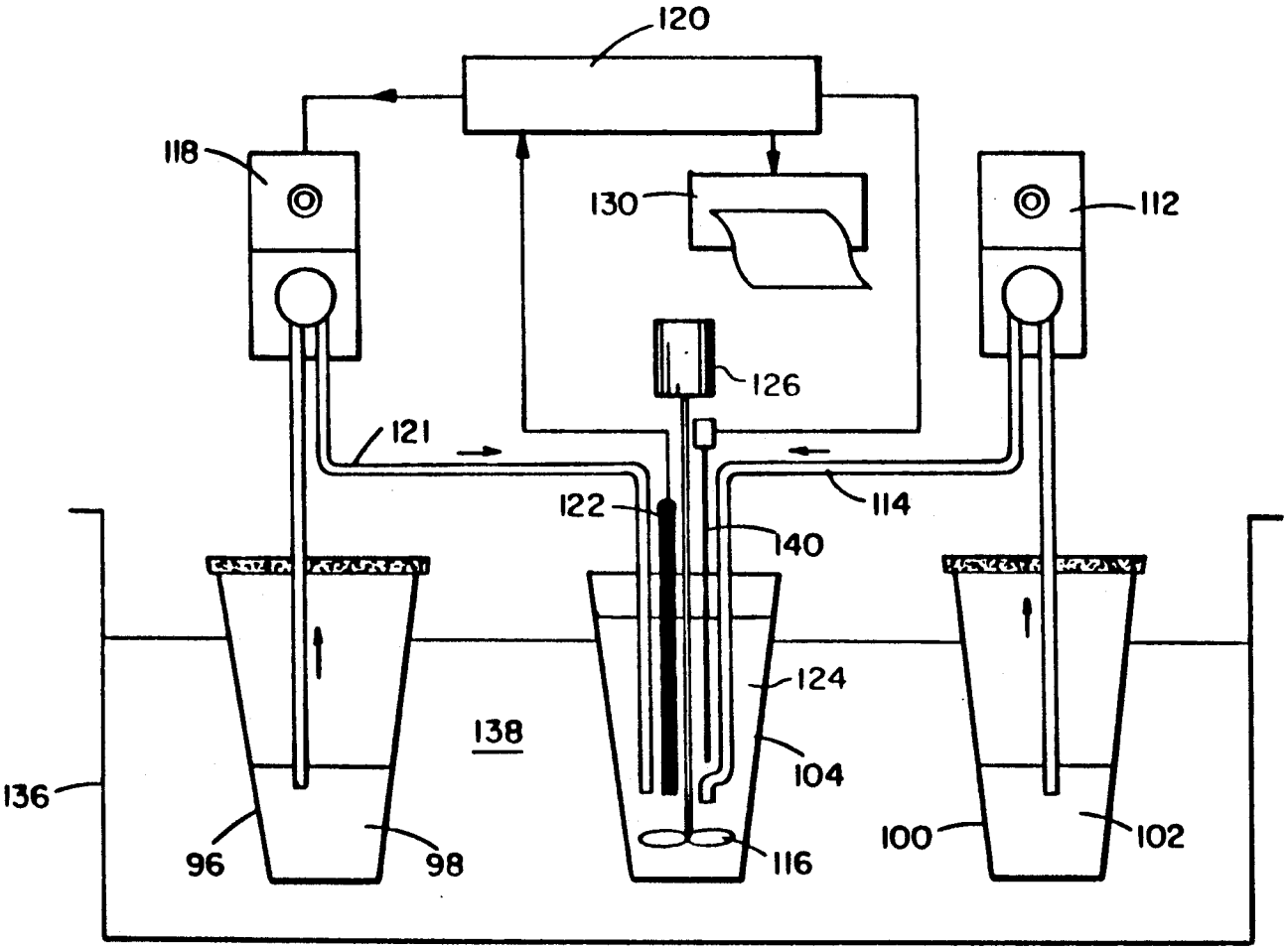
FIG. 2 illustrates schematically the small scale device for the preparation of the dispersions of this invention in a semicontinuous mode.

FIGS. 1 and 2 describe respectively the continuous and the semicontinuous equipment to prepare such dispersions as those of this invention for small laboratory size preparation. The practice of the invention requires neutralization to be complete within not more than about two minutes from the time the basic auxiliary solvent, coupler, liquid carboxylic acid solution, and the surfactant join. For obtaining small particle size it is preferred that neutralization be complete within much less than about one minute. The device of FIG. 1 was designed for continuous pH-controlled precipitation of dispersions of this invention. Container 92 is provided with an aqueous surfactant solution 94. Container 96 is provided with an acid solution. Container 100 contains a basic coupler solution in the auxiliary solvent 102. Container 104 provides a mixing and reacting chamber where the dispersion formation takes place. Container 106 is a collector for the formed coupler dispersion 158. In operation the surfactant solution 94 is metered by pump 108 through line 110 into the reaction vessel 104. At the same time the basic coupler solution is metered by pump 112 through line 114 into the reactor 104 at a constant predetermined rate. The solutions are agitated by stirrer 116, and acid 98 is metered by pump 118 through line 121 into the reactor 104 to neutralize the solution. The pumping by metering pump 118 is regulated by controller 120. Controller 120 is provided with a pH sensor 122 that senses the pH of the dispersion 124 in reactor 104 and controls the amount and the rate of the addition of acid 98 added by pump 118 to neutralize the content of the reaction chamber. The drive for stirrer 116 is 126. The recorder 130 constantly records the pH of the solution to provide a history of the dispersion 124. Metering pump 132 withdraws the dispersion from reactor 104 and delivers it to the container 106 using pump 132 and line 150 where it may exit from the outlet 134. In a typical precipitation there is a basic coupler solution 102 of solvent, sodium hydroxide solution, and the liquid carboxylic acid. The surfactant is in water, and the neutralizing acid is an aqueous solution of acetic or propionic acid. The reaction chamber has a capacity of about 800 ml. The coupler solution tank 100, has a capacity of about 2500 ml. The surfactant solution tank 92, has a capacity of about 5000 ml. The acid solution tank has a capacity of about 2500 ml and the dispersion collection tank has a capacity of about 10,000 ml. The temperature is controlled by placing the four containers 92, 96, 104, and 100 in a bath 136 of water 138 whose temperature can be regulated to its temperature up to 100° C. Usually precipitation is carried out at 25° C. The temperature of the bath 138 is controlled by a steam and cold water mixer (not shown). The temperature probe 140 is to sense the temperature of the reactor. This is necessary for correct pH reading. The neutralization of the basic coupler solution in the reaction chamber 104 by the proportionally controlled pump 118 which pumps in acid solution 98 results in control of pH throughout the run to ±0.2 of the set pH value which is usually about 6.0. In the continuous mode, similar volumes as pilot scale equipment described below have been made, except that the flow rates being about 20–30 times smaller than the pilot scale equipment of FIGS. 3 and 4, the preparation takes about 20–30 times longer.

FIG. 2 schematically illustrates a semicontinuous system for forming dispersions of coupler materials. Identical items are labeled the same as in FIG. 1. Because of reduced scale, the sizes of acid kettle 96 and the coupler kettle 100 are smaller (about 800 ml each). In the system of FIG. 2, the reactor 104 is initially provided with a crude aqueous surfactant solution. Into this is pumped a basic solution of coupler, carboxylic acid, and solvent 102 through pipe 114. pH sensor 122 that works through controller 120 to activate pump 118 and neutralize the dispersion to a pH of about 6 by pumping acetic acid 98 through metering pump 118 and line 121 to the reactor 104. Reactor 104 must be removed, dumped, and refilled with the aqueous surfactant solution in order to start a subsequent run. However, the systems of FIGS. 1 and 2 do provide fast control of pH in order to produce photographically useful dispersions. Dispersions may be formulated and optimized using the semicontinuous process using this equipment before scale up for continuous running in continuous pilot scale equipment such as that of FIGS. 3 and 4.

Figure 3:
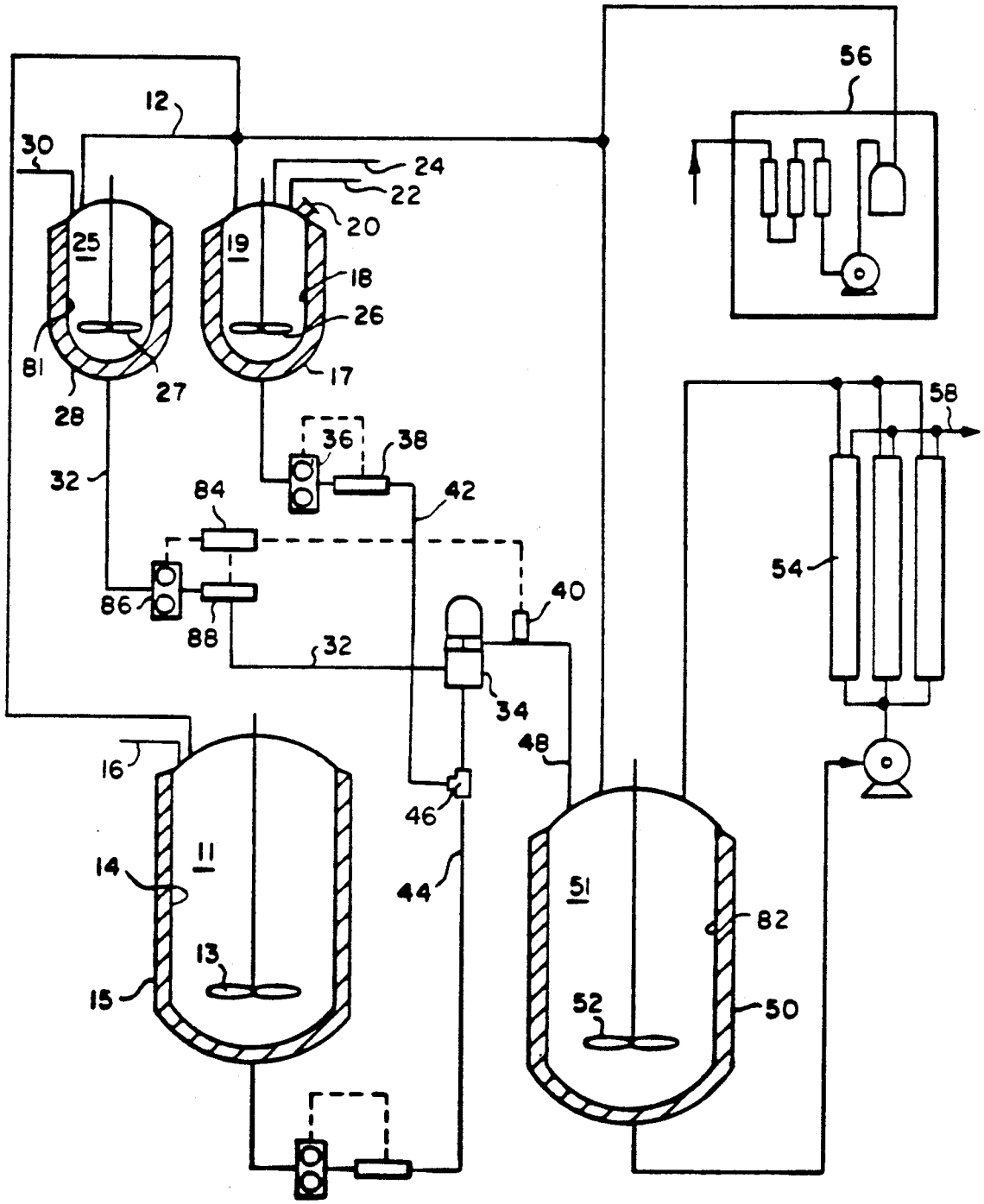
FIG. 3 illustrates schematically the pilot scale device for the preparation of the dispersions of this invention in a continuous mode.

The schematic of FIG. 3 illustrates apparatus 10 for performing the process of the invention in a pilot scale continuously. The apparatus is provided with high purity water delivery line 12. Tank 14 contains the aqueous surfactant solution. Jacket 15 on tank 14 regulates the temperature of the tank. Surfactant enters the tank through line 16. Agitator 13 produces a uniform aqueous solution of the surfactant in tank 14. Line 16 is also used to feed the surfactant. Tank 18 contains the basic coupler/liquid carboxylic acid solution 19. Jacket 17 controls the temperature of materials in tank 18. In tank 18 the coupler enters through manhole 20, a base material such as aqueous sodium hydroxide solution entering through line 22, and solvent such as n-propanol entering through line 24. The solution is maintained under agitation by the mixer 26. Tank 81 contains acid solution 25 such as propionic acid entering through line 30. The tank 81 is provided with a heat jacket 28 to control the temperature, although with the acids normally used, it is not necessary. In operation, the acid is fed from tank 81 through line 32 to mixer 34 via the metering pump 86 and flow meter 88. A pH sensor 40 senses the acidity of the dispersion as it leaves mixer 34 and allows the operator to adjust the acid pump 86 to maintain the proper pH in the dispersion exiting the mixer 34. The photographic component 19 passes through line 42, metering pump 36, flow meter 38, and joins the surfactant solution in line 44 at the T fitting 46. The particles are formed in mixer 34 and exit through pipe 48 into the ultrafiltration tank 82. In tank 82 the dispersion 51 is held while it is washed by ultrafiltration membrane 54 to remove the solvent and salt from solution and adjust the material to the proper water content for makeup as a photographic component. The source of high purity water is purifier 56. Agitator 13 agitates the surfactant solution in tank 14. Agitator 27 agitates the acid solution in tank 81. The impurities are removed during the ultrafiltration process through permeate (filtrate) stream 58.

Figure 4:
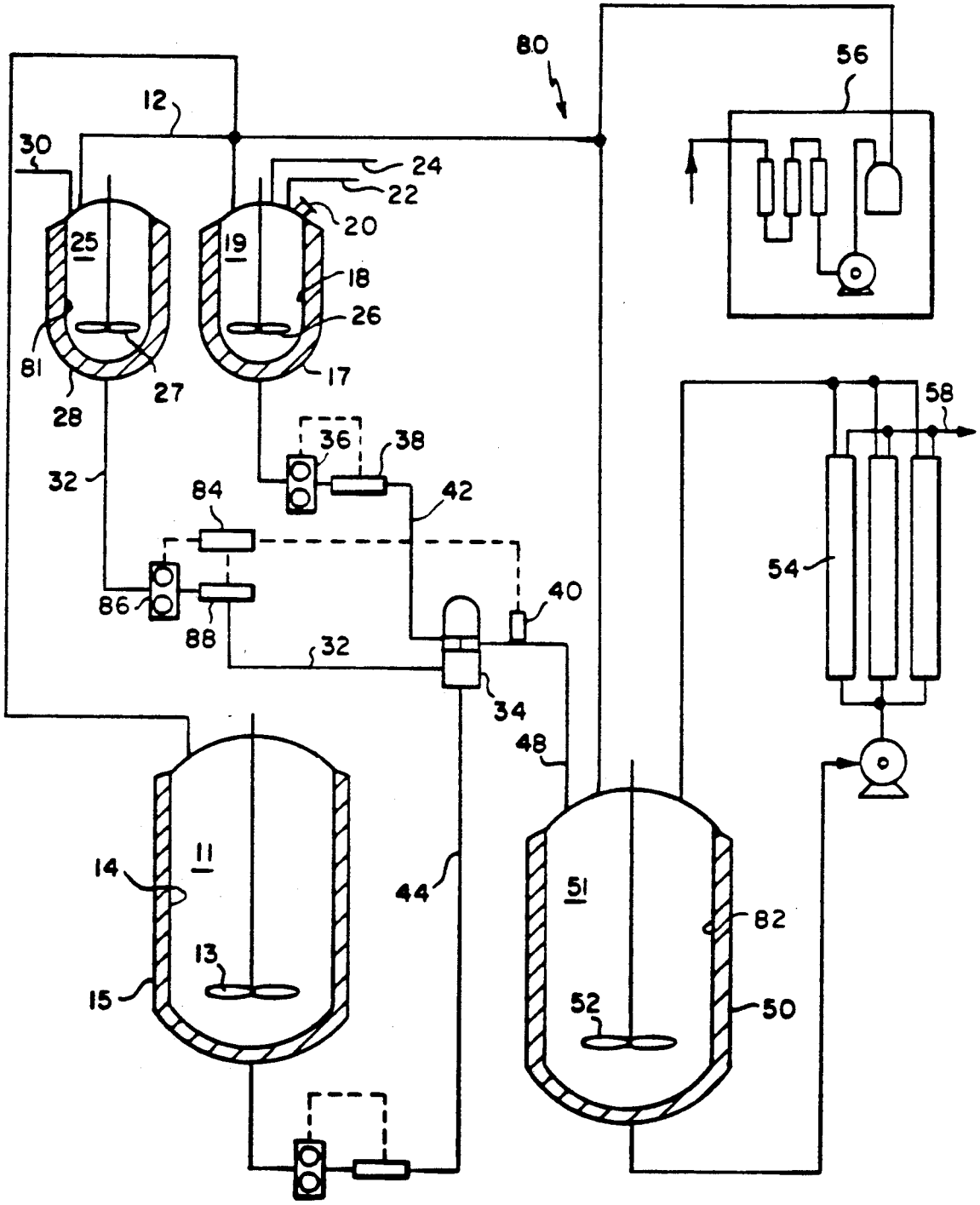
FIG. 4 illustrates schematically an alternate pilot scale device for the preparation of the dispersions of this invention in a continuous mode.

The apparatus 80 schematically illustrated in FIG. 4 is similar to that illustrated in FIG. 3 except that the acid solution in pipe 32, the aqueous surfactant solution in pipe 44, and the basic coupler/liquid carboxylic acid solution in an auxiliary solvent in pipe 42 are directly led to mixing device 34. Corresponding items in FIG. 3 and FIG. 4 have the same numbers. In this system all mixing takes place in the mixer 34 rather than joining of the surfactant solution and the photographic component in the T connection immediately prior to the mixer as in the FIG. 3 process.

The surfactants of the invention may be any surfactant that will aid in formation of stable dispersions of particles. Typical of such surfactants are those that have a hydrophobic portion to anchor the surfactant to the particle and a hydrophilic part that acts to keep the particles separated either by steric repulsion (see, for example, P. Bagchi, J. Colloid and Interface Science, Vol. 47, page 86, and 110, 1974, Vol. 41, page 380, 1972, and Vol. 50, page 115, 1975) or by charge repulsion. Many classes of surfactants can be utilized to perform this invention. There can, in general, be classified in the following classes:

Class I: Surfactants with single, double, or triple $C_2$ to $C_{25}$ hydrocarbon chain terminated with one or more charged head groups. Additional polymeric or oligomeric steric stabilizers could be used with such surfactants.

Examples of this class of surfactants are as follows:

$CH_3-(CH_2)_{11}-SO_4^-Na^+$ I-1

(Sodium Dodecyl Sulfate)

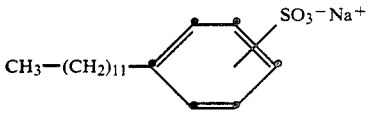

I-2

(Sodium Dodecyl Benzene Sulfonate)

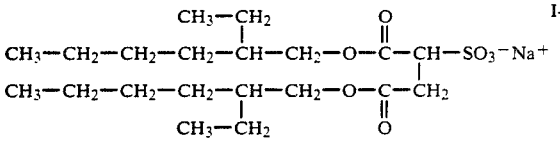

I-3

(Aerosol OT Cyanamid)

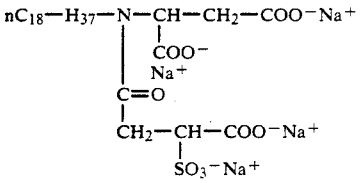

I-4

(Aerosol 22 Cyanamid)

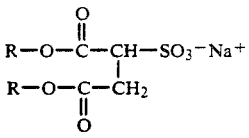

I-5 where R = $CH(CH_3)C_4H_9$
(Aerosol MA Cyanamid)

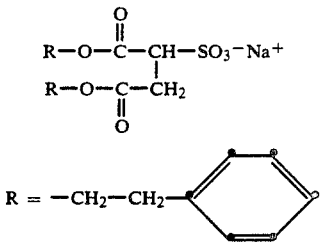

I-6

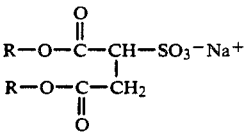

I-7

-continued

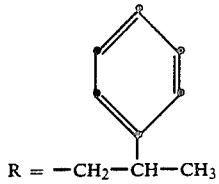

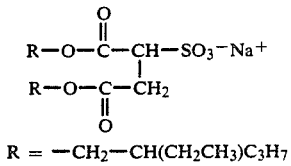

I-8

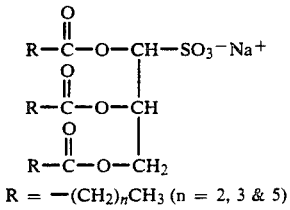

I-9

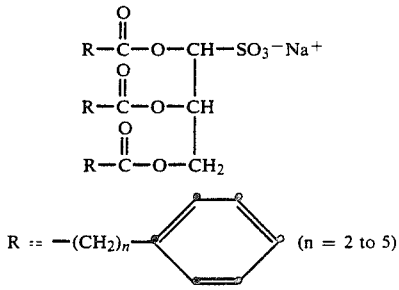

I-10

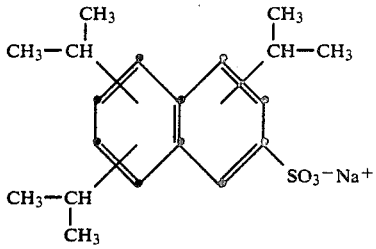

I-11

(Alkanol-XC Dupont)

Use of additional polymeric or oligomeric steric stabilizers with in addition to such surfactants can provide additional colloidal stability of such dispersions and can be added if necessary. Polymeric materials for such use are water soluble, homo-, or co-polymers such as polyvinyl pyrrolidone, dextran, and derivatized dextrans polyvinyl alcohol and poly(vinyl pyrrolidone-co-vinyl alcohol) of various ratios. Other types of oligomeric co-stabilizers that can be used are block oligomeric compounds comprising hydrophobic polyoxypropylene blocks A and hydrophilic polyoxyethylene blocks B joined in the manner of A-B-A, B-A-B, A-B, $(A\text{-}B)_n{\equiv}G{\equiv}(B\text{-}A)$, or $(B\text{-}A)_n{\equiv}G{\equiv}(A\text{-}B)$, where G is a connective organic moiety and n is between 1 and 3. Examples of such surfactants are shown in Table A.

TABLE A

Examples of Block Oligomeric Costabilizers For Use Along With Surfactants of Class I

| ID | Name (Manufacturer) | Best Known Structure | Molecular Weight Range |
|---|---|---|---|
| P-1 | Pluronic TM Polyols (BASF) | $HO-(CH_2CH_2-O)_a-(CH(CH_3)-CH_2-O)_b-H-(OCH_2-CH_2)_c-H$ | 1,100 to 14,000 |
| P-2 | Pluronic TM -R Polyols (BASF) | $HO-(CH(CH_3)-CH_2-O)_a-(CH_2-CH_2-O)_b-H-(O-CH_2-CH(CH_3))_c-H$ | 1,900 to 9,000 |
| P-3 | Plurodot TM Polyols (BASF) | Liquid Polyethers Based on Alkoxylated Triols | 3,200 to 7,500 |
| P-4 | Tetronic TM Polyols (BASF) | $(HO-(CH_2CH_2-O)_y-(CH(CH_3)-CH_2-O)_x)_2N-CH_2-CH_2-N(HO-(CH_2CH_2-O)_y-(CH(CH_3)-CH_2-O)_x)_2$ | 3,200 to 27,000 |

Class II: Surfactants comprising between 6 to 22 carbon atom hydrophobic tail with one or more attached hydrophilic chains comprising at least 4 oxyethylene and/or glycidyl ether groups that may or may not be terminated with a negative charge such as a sulfate group.

Examples of such surfactants are as follows:

II-1

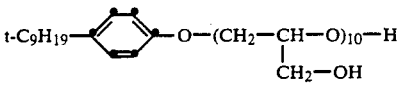

Olin 10G (Dixie)

II-2

$n\text{-}C_{12}H_{25}-O-(CH_2-CH_2-O)_{12}-SO_3^-Na^+$

Polystep B-23 (Stepan)

II-3

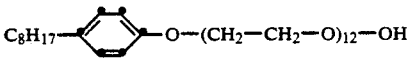

Triton TX-102 (Rohm & Haas)

II-4

$n\text{-}C_{12}H_{25}-O-(CH_2-CH_2-O)_{23}-OH$

Tricol LAL-23 (Emery)

-continued

II-5

$C_{12}H_{25}-O-(CH_2-CH_2-O)_{15}-CH_2-CH_2-SO_3^-Na^3$

Avanel S-150 (PPG)

II-6

$n\text{-}C_{12}H_{25}-O-(CH_2-CH_2-O)_n-C(=O)-CH(CH_2-COO^-Na^+)-SO_3^-Na^+$, n = 3-5

Aerosol A102 (Cyanamid)

II-7

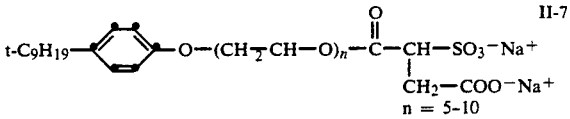

Aerosol A103 (Cyanamid)

Class III: Sugar surfactants, comprising between one and three 6 to 22 carbon atom hydrophobic tails with one or more attached hydrophilic mono, di, tri or oligosaccharidic chains that may or may not be terminated by a negatively charged group such as a sulfate group.

Examples of such surfactants are as follows:

III-1

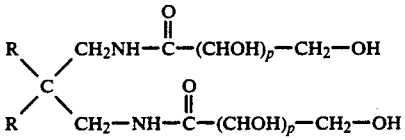

where, R = $n\text{-}CH_3-(CH_2)_x-$ (where x = 3 to 10)

R =

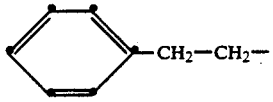

P = 3 to 10

-continued
III-2
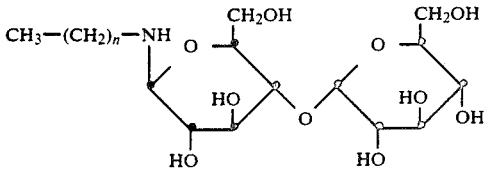
where, n = 3 to 15
III-3
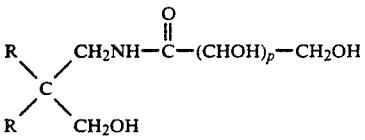
where, R = n-$CH_3$—$(CH_2)_x$— (where x = 3 to 10)
R = 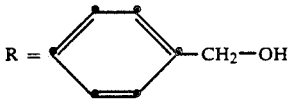
P = 3 to 15
III-4
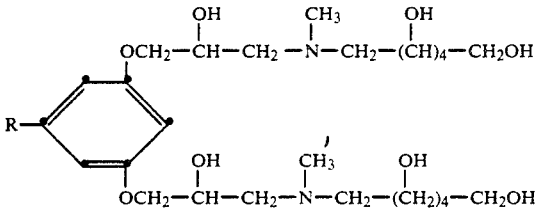
where, R = n-$CH_3$—$(CH_2)_x$—
(where, x = 1 to 5)
III-5
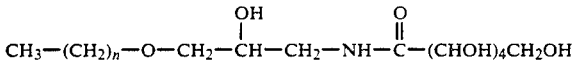
where, n = 3 to 15
III-6
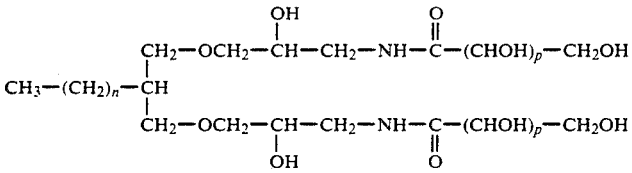
where, n = 2 to 12
p = 3 to 10
III-7
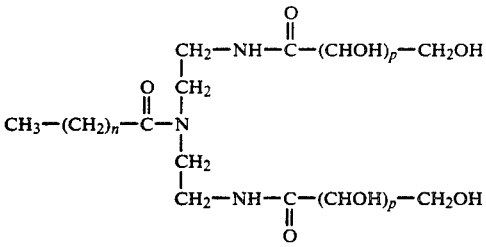
where, n = 2 to 18
p = 3 to 10
III-8
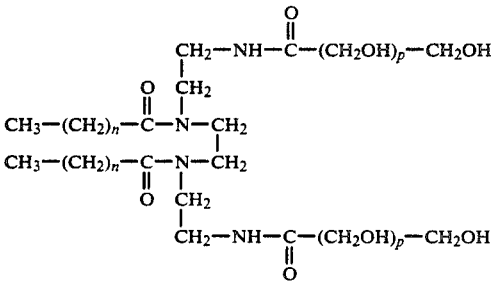

-continued where, n = 2 to 18
p = 3 to 10

The invention may be practiced with any hydrophobic photographic component that can be solubilized by base and solvent. Typical of such materials are colored dye-forming couplers, development inhibitor release couplers, development inhibitors, filter dyes, UV-absorbing dyes, development boosters, development moderators, and dyes. Suitable for the process of the invention are the following coupler compounds which have been utilized to form precipitated dispersions:

C-1

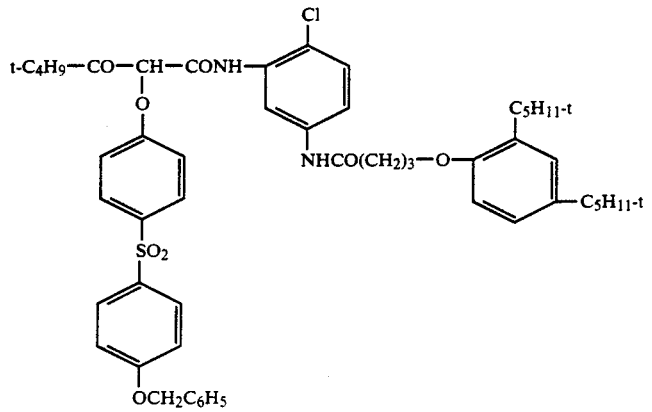

C-2

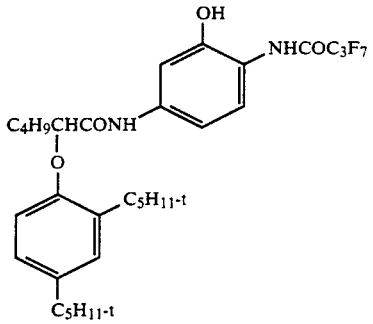

C-3

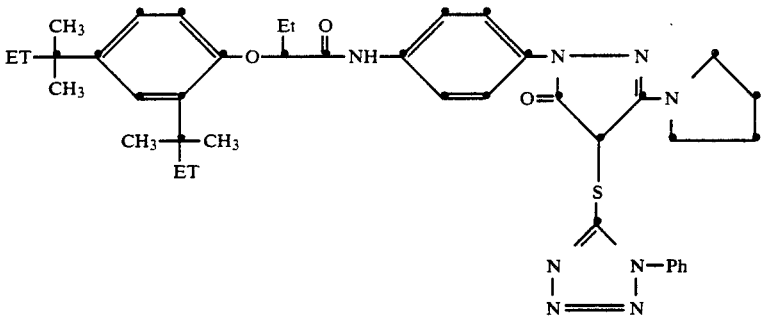

C-4

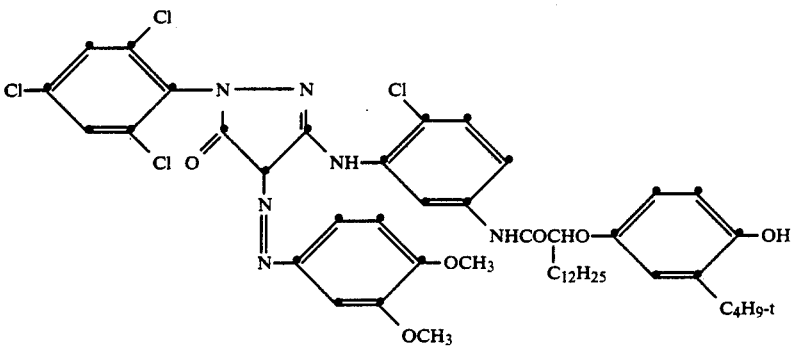

-continued
C-5
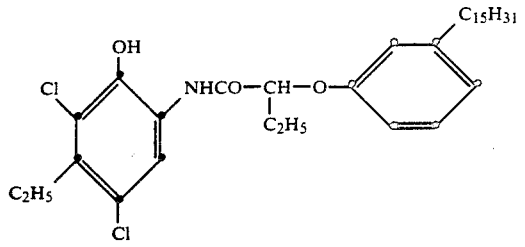
C-6
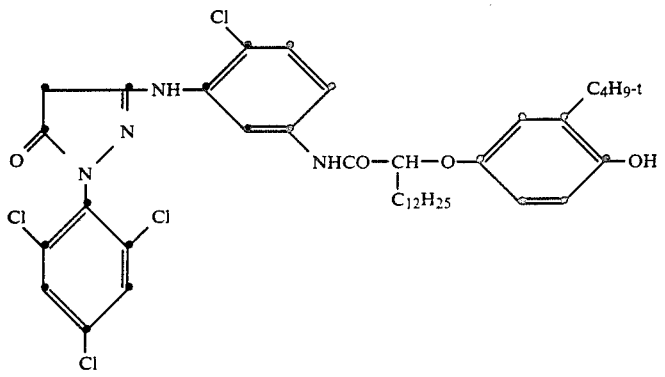
C-7
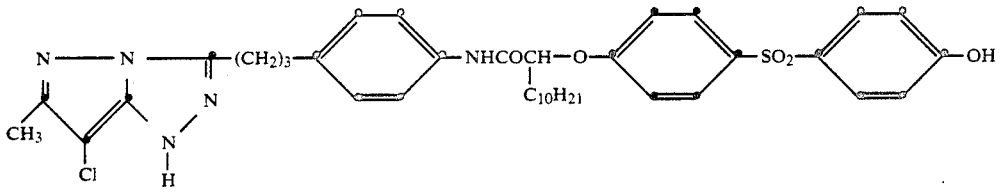
C-8
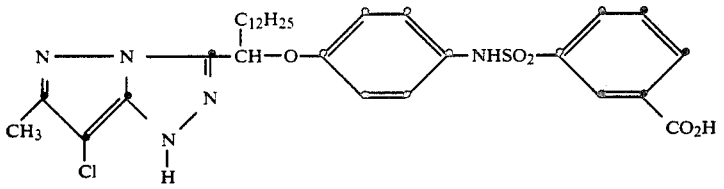
C-9
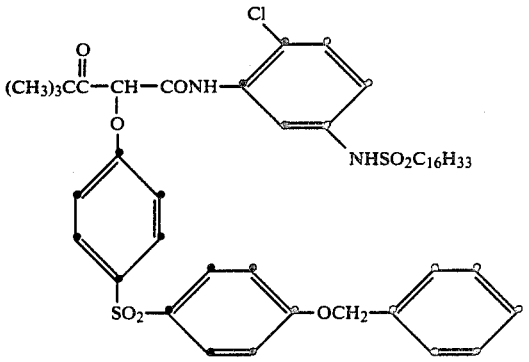

-continued
C-10
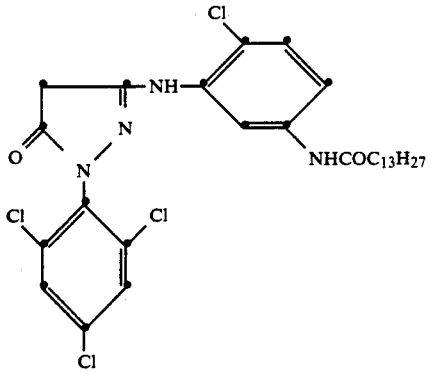
C-11
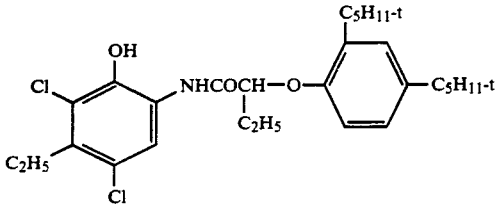
C-12
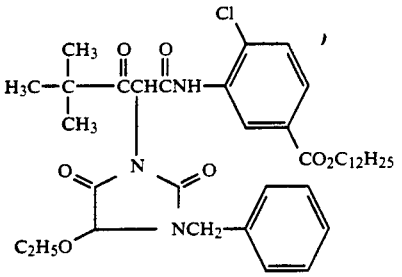
C-13
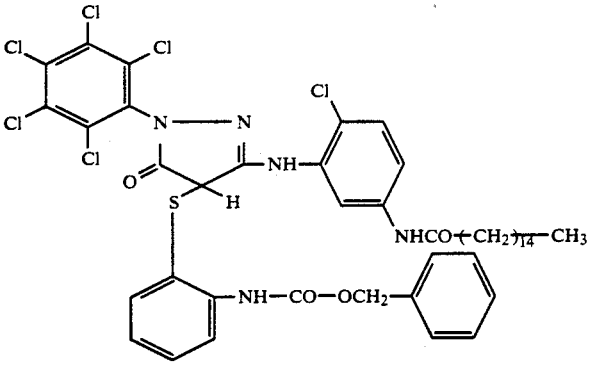
C-14
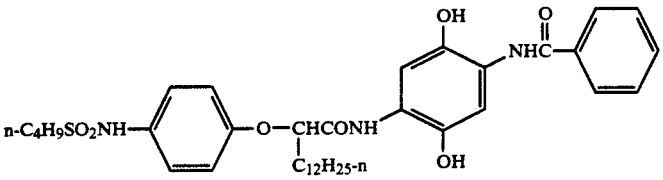
C-15
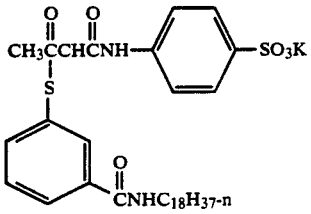

-continued

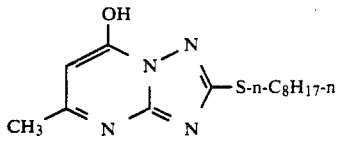

C-16

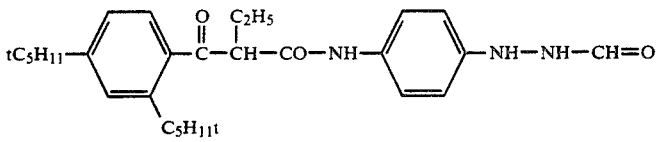

C-17

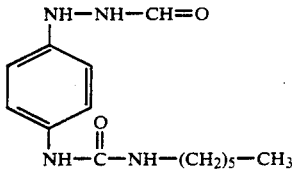

C-18

All of the above coupler compounds are amenable to the described process of the invention. Many of the precipitated dispersions of the above list are photographically very active and some are substantially more active compared to their conventional milled dispersions. However, some of the examples of the above list such as, of example, compounds C-3 and C-4, are extremely inactive as precipitated dispersions. These are the compounds that need to have liquid carboxylic acids incorporated in them to produce photographically active dispersions that can be used in viable photographic systems. The couplers that are typically most benefited by the process of the invention are those that are without many polar or ionizable groups, as such couplers are less reactive unless in the presence of an activating solvent.

The mixing chamber, where neutralization takes place, may be of suitable size that has a short residence time and provides high fluid shear without excessive mechanical shear that would cause excessive heating of the particles. In a high fluid shear mixer, the mixing takes place in the turbulence created by the velocity of fluid streams impinging on each other. Typical of mixers suitable for the invention are centrifugal mixers, such as the "Turbon" centrifugal mixer available from Scott Turbon, Inc. of Van Nuys, Calif. It is preferred that the centrifugal mixer be such that in the flow rate for a given process the residence time in the mixer will be of the order of 1-30 seconds. Preferred residence time is 10 seconds to prevent particle growth and size variation. Mixing residence time should be greater than 1 second for adequate mixing.

The volatile water miscible solvents suitable for dissolving the photographic component may be any suitable solvent that may be utilized in the system in which precipitation takes place by solvent shift and/or pH shift. Typical of such materials are the solvents acetone, methyl alcohol, ethyl alcohol, isopropyl alcohol, tetrahydrofuran, dimethylformamide, dioxane, N-methyl-2-pyrrolidone, acetonitrile, ethylene glycol, ethylene glycol monobutyl ether, diacetone alcohol, ethyl acetate and cyclohexanone. Suitable water miscible volatile solvents comprise propanol, methanol, cyclohexanone, ethyl acetate, or mixtures thereof. A preferred solvent is n-propanol because n-propanol provides a very stable supersaturated basic coupler solution that is used for this precipitation process.

The activating liquid carboxylic acids in general are water immiscible compounds when protonated. However, at high pH when the carboxylic acids are ionized, these compounds become soluble in water and behave like an "auxiliary solvent."Therefore, such liquid carboxylic acid materials may be classified as a pH switchable permanent-auxiliary solvent.

$$\underset{\text{water immiscible}}{R{-}COOH} \underset{\text{Acid}}{\overset{\text{Base}}{\rightleftharpoons}} \underset{\text{water miscible}}{R{-}COO^-}$$

The group R can be any organic moiety such that R—COOH is a liquid and water-insoluble or virtually water-insoluble, and the ionized species $R{-}COO^-$ is water miscible. In the examples it will be shown that if R—COOH is a solid, coprecipitation attempts lead to phase separation and also lowering of activity of the resultant precipitated dispersion. Some specific examples of such liquid carboxylic acids are compounds where R is comprised of unsaturated aliphatic acid, such as:

Oleic Acid: $CH_3{-}(CH_2)_7{-}CH{=}CH{-}(CH_2)_7{-}COOH$

Linoleic Acid: $CH_3{-}(CH_2)_4{-}CH{=}CH{-}CH_2{-}CH{=}CH{-}(CH_2)_7{-}COOH$

Linolenic Acid: $CH_3{-}(CH_2{-}CH{=}CH)_3{-}CH_2{-}(CH_2)_6{-}COOH$

In a more general term such compounds may be defined as liquid compounds that are insoluble in water in a protonated condition and undergo deprotonation in base and become water miscible.

$$\underset{\text{water insoluble liquid}}{Q{-}H} \underset{\text{Acid}}{\overset{\text{Base}}{\rightleftharpoons}} \underset{\text{water miscible}}{Q^{\ominus}}$$

In this general definition Q is an organic moiety such that Q-H is a liquid and water-insoluble and becomes water soluble when treated with base upon deprotonation.

The liquid carboxylic acid generally comprises between about 0.10 and about 5 times the weight of said coupler.

In the field of conventional milled photographic dispersions Japanese Application 63/85633 from Fuji Photo Film Co., Ltd. describes the use of gelatin dispersed organic carboxylic acids in photographic elements. Similarly, preparation of milled dispersions containing gelatin of coupler and wax-like saturated and unbranched fatty acids are described in U.S. Pat. No. 3,676,142 and of various organic fatty oils in U.S. Pat. No. 3,936,303. However, the precipitated dispersions described in this invention comprise coprecipitation of liquid carboxylic acids along with photographic couplers to form gelatin free stable dispersions in water.

The neutralizing acid and base may be any materials that will cause a pH shift and not significantly decompose the photographic components. The acid and base utilized in the invention are typically sodium hydroxide as the base and propionic acid or acetic acid as the acid, as these materials do not significantly degrade the photographic components and are low in cost.

The process of this invention leads to gelatin free, fine particle colloidal dispersions of photographic materials that are stable from precipitation at least for six weeks at room temperature. This is a cost saving feature as conventional milled dispersions need to be stored under refrigerated conditions. Under refrigerated conditions, dispersions prepared by the method of this invention have photographically useful lives anywhere up to two months.

DESCRIPTION OF MEASUREMENTS

All particle sizes of the precipitated dispersions were made by photon correlation spectroscopy (PCS) as described by B. Chu, Laser Light Scattering, Academic Press, 1974, New York Unless otherwise mentioned, all photographic development we carried out by the standard C-41 color development process as described in the British Journal of Photography Annual of 1988, pages 196–198. Solution reactivity rates of the dispersions were determined using an automated dispersion reactivity analysis (ADRA) method. A sample of the dispersion is mixed with a carbonate buffer and a solution containing CD-4 developer.

CD-4 Developer

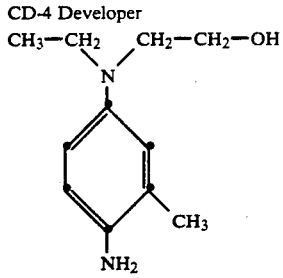

Potassium sulfite is added as a competitor. The carbonate buffer raises the pH of this reaction mixture to a value close to the normal processing pH (10.0). An activator solution containing the oxidant potassium ferricyanide is then added. The oxidant generates oxidized developer which reacts with the dispersed coupler to form image dye and with sulfite to form side products. After the addition of a clarifier (solution of Triton X-100), the dye density is read using a flow spectrometer system. The concentration of dye is derived from the optical density and a known extinction coefficient.

A kinetic analysis is carried out by treating the coupling reaction as a homogeneous single phase reaction. It is also assumed that the coupling reaction and the sulfonation reaction (sulfite with oxidized developer) may be represented as second-order reactions. Furthermore, the concentrations of reagents are such that the oxidant and coupler are in excess of the developer. Under these conditions, the following expression is obtained for the rate constant of the coupling reaction:

$$k=k'\ln[a/(a-x)]/\ln[b/(b-c+x)]$$

where k' is the sulfonation rate constant, a is the concentration of coupler, b is the concentration of sulfite, c is the concentration of developer, and x is the concentration of the dye. The rate constant k is taken as a measure of dispersion reactivity. From an independently determined or known value of k' and with this knowledge of all of the other parameters, the rate constant k (called the automated dispersion reactivity analysis, ADRA, rate) is computed.

MONOCHROME COATING FORMAT FOR PHOTOGRAPHIC EVALUATIONS

The monochrome bilayer coating format used for the photographic evaluations of the coupler dispersions was as follows:

Layer 1 (TOP): 2.691 g/m$^2$ of gelatin overcoat. 0.113 g/m$^2$ of bis(vinylsulfonyl)methane ether hardener.

Layer 2 (BOTTOM): Indicated amounts of image, development inhibitor releasing (DIR) or colored couplers, with or without indicated amounts of permanent coupler solvent.

1.614 g/m$^2$ of silver in a green-sensitized, medium speed, three-dimensional, 320 nm diameter AgBr(I) 12 mole percent Iodide crystal. 3.767 g/m$^2$ of gelatin.

Support: Clear ester subbed with a thin polymer layer for the adhesion of the gelatin coatings.

Coatings were made in a slide hopper coating and drying machine in two passes.

EXAMPLES

The following examples are intended to be illustrative and not exclusive of the invention. Parts and percentages are by weight unless otherwise specified.

EXAMPLE 1

(Control) Preparation of Precipitated Magenta Image Coupler Dispersion of Compound C-7

This example utilizes a process and apparatus generally as schematically illustrated in FIG. 3. The coupler solution, surfactant solution, and acid solution are prepared as follows:

| | | |
|---|---|---|
| Coupler solution: | Coupler C-7 | 1550 g |
| | 4% NaOH | 2475 g |
| | n-propanol | 2880 g |
| | | 6905 g |
| | Flow rate: | 342 g/min |

Above ingredients were mixed together and heated to 50° C. to dissolve the coupler and then cooled to 30° C. before use.

| | | |
|---|---|---|
| Surfactant solution: | High purity water | 51600 g |
| | Alkanol-XC (10%) | 1930 g |
| | Polyvinyl Pyrrolidone (molecular weight about 40,000) | 780 g |
| | | 54310 g |
| | Flow rate: | 2686 g/min |
| Acid solution: | Acetic acid | 214 g |
| | High purity water | 1214 g |
| | | 1428 g |
| | Flow rate: | Approximately 53 g/min (adjusted to control the pH of the dispersion between 5.4 to 5.6). |

The description of the apparatus setup for this example is as follows:

Temperature-controlled, open-top vessels.

Gear pumps with variable-speed drives.

A high fluid shear centrifugal mixer operated with a typical residence time of about 2 sec.

A SWAGE-LOC "T" fitting where surfactant and coupler streams join.

Residence time in pipe between T-fitting and mixer $<<1$ sec.

In-line pH probe used to monitor pH in the pipe exiting the mixer.

Positive displacement pump for recirculation in batch ultrafiltration.

Ultrafiltration membrane OSMONICS 20K PS 3' by 4" spiral-wound permeator.

Process Description

The three solutions are continuously mixed in the high-speed mixing device in which the ionized and dissolved coupler is reprotonated causing precipitation. The presence of the surfactant stabilizes the small particle size dispersion. The salt byproduct of the acid/base reaction is sodium propionate. Ultrafiltration is used for constant-volume washing with distilled water to remove the salt and the solvent (n-propanol) from the crude dispersion. The recirculation rate is approximately 20 gal/min. with 50 psi back pressure which gives a permeate rate of about 1 gal/min. The washed dispersion is also concentrated by ultrafiltration to the desired final coupler concentration of about 10–15 weight percent. The time to perform the ultrafiltration and produce the final coupler concentration is about 1 hour. Average particle size is about 66 nanometers as measured by Photon Correlation Spectroscopy.

EXAMPLE 2

(Control) Preparation of Precipitated Magenta DIR Coupler Dispersion of Compound C-3 (Companion)

This example utilizes a process and apparatus generally as schematically illustrated in FIG. 3. The coupler solution, surfactant solution, and acid solution are prepared as follows:

| | | |
|---|---|---|
| Coupler solution: | Coupler C-3 | 1000 g |
| | 20% NaOH solution | 250 g |
| | n-propanol | 2000 g |
| | | 3250 g |
| | Flow rate: | 275 g/min |

Above ingredients were mixed together and heated to 50° C. to dissolve the coupler and then cooled to 30° C. before use.

| | | |
|---|---|---|
| Surfactant solution: | High purity water | 35000 g |
| | Aerosol A103 (33%) solution | 750 g |
| | (American Cyanamid) | 35750 g |
| | Flow rate: | 3028 g/min |
| Acid solution: | Propionic acid | 150 g |
| | High purity water | 850 g |
| | | 1000 g |
| | Flow rate: | Approximately 55 g/min (adjusted to control the pH of the dispersion between 5.9 to 6.1). |

The description of the apparatus setup and the process for this example is similar to that in Example 1. Average particle size of the dispersion as measured by Photon Correlation Spectroscopy was 39 nm. The solution ADRA rectivity rate of the dispersion was 1390 l/(mole sec).

EXAMPLE 3

(Control) Preparation of Precipitated Yellow Colored Magenta Coupler Dispersion of Compound C-4 (Companion)

This example utilizes a process and apparatus generally as schematically illustrated in FIG. 3. The coupler solution, surfactant solution, and acid solution are prepared as follows:

| | | |
|---|---|---|
| Coupler solution: | Coupler C-4 | 2000 g |
| | 20% NaOH | 500 g |
| | n-propanol | 4000 g |
| | | 6500 g |
| | Flow rate: | 474 g/min |

Above ingredients were mixed together and heated to 60° C. to dissolve the coupler and then cooled to 30° C. before use.

| | | |
|---|---|---|
| Surfactant solution: | High purity water | 40000 g |
| | Aerosol A102 (33%) | 1500 g |
| | (American Cyanamid) | 41500 g |
| | Flow rate: | 3028 g/min |
| Acid solution: | Acetic acid | 300 g |
| | High purity water | 1700 g |
| | | 2000 g |
| | Flow rate: | Approximately 75 g/min (adjusted to control the pH of the dispersion between 5.9 to 6.1). |

The description of the apparatus setup and the process for this example is similar to that in Example 1. Average particle size of the dispersion as measured by Photon Correlation Spectroscopy was 13 nm. The solution ADRA rectivity rate of the dispersion was 18500 l/(mole sec).

EXAMPLE 1–16

Coprecipitated Dispersion of Yellow Image Coupler C-1 With Lauric Acid, Oleic Acid, and Linoleic Acid These examples utilize a process and the apparatus generally as schematically described in FIG. 2. The composition and the amount of the components used in the various solutions are shown in Table B. The coupler in these exmaples is a yellow image coupler C-1. The ingredients of the coupler solution were mixed together and heated to 60° C. for complete dissolution and then cooled down to room temperature and placed in the coupler solution container 100. The surfactant solution at room temperature was placed into the reaction chamber 104. The neutralizing 15% propionic acid solution was placed in vessel 96. The individual precipitations of Examples 4 through 16 were carried out as follows using surfactant Aerosol A102:

| | |
|---|---|
| Precipitation conditions | Temperature 25° C.<br>Coupler solution pump rate = 24 ml/min<br>Acid solution pump rate = proportionally controlled to maintain reaction pH of 6.0<br>Stirring rate = 2000 RPM |

The precipitations were started by setting the pH controller at pH 6.0 and starting the coupler solution pump 112. As the basic coupler solution entered the reaction vessel 104, the pH of the mixture increased. This was sensed by the pH probe which then caused the activation of the acid pump 118 to pump in acid into the stirred reaction chamber 104 to lower the pH and cause precipitation of the coupler in the form of a fine particle stable dispersion. In such coprecipitation processes were formed fine particle coupler dispersions containing the indicated acids. The dispersions were dialyzed against distilled water for 24 hours to remove the formed salts and the auxiliary solvents. The average particle diameter of the dispersion particle as measured by Photon Correlation Specroscopy. The ADRA reactivity rates were determined using an automated dispersion reactivity analyzer.

For comparison of ADRA reactivity, a prior art milled dispersion of coupler C-1 was prepared (The Theory of Photographic Processes, Ed. T. H. James, 4th Ed., MacMillan, New York, 1977, page 384) with the following composition, using the surfactant Alkanol XC:

12.92% Coupler C-1
3.23% Dibutyl Phthalate
3.23% 2-(2-Butoxyethoxy)-Ethyl Acetate
8.74% Gelatin and rest water This dispersion had an average particle diameter of about 200 nm as determined by Sedimentation Field Flow Fractionation. The surfactant Alkanol XC was used at a level of 3% based upon the coupler weight. The ADRA reactivity rate of such a dispersion was 1250 l/(mole sec). Therefore, it is seen in the comparison of Table B that the no-acid precipitated dispersion of coupler C-1 at a particle diameter of 40 nm (PCS) gave a much larger ADRA reactivity rate of 8650 l/(mole sec). In other words, the no-acid precipitated dispersion of coupler C-1 is extremely reactive compared to a conventional milled dispersion. It is also observed that coprecipitation with either lauric, oleic, or linoleic acids produced dispersion that are in many cases much less active compared to the no-acid control precipitated dispersion of Example 4. Therefore, it is concluded from this observation that the coprecipitation with acids for the case of a highly active precipitated dispersion does not enhance the reactivity of the coupler, but rather it decreases its reactivity. It is also observed that lauric acid which is a solid at room temperature, upon coprecipitation shows extensive phase separation (it is estimated from the dry weight of the precipitate. See Table B) for incorporation levels larger than 0.25 g of acid per 9 g coupler. Therefore, it is clear that solid acids (such as lauric acids) are not preferred for the coprecipitation of this invention. Also couplers that produce highly active precipitated dispersions are not the preferred couplers of this invention, as their performance is not improved by the liquid carboxylic acids of the invention.

TABLE B

Acid Coprecipitated Dispersions Prepared With Yellow Image Coupler C-1

| | | Coupler Solution | | | | Surfactant Solution | | Analysis Results | | | | | |
|---|---|---|---|---|---|---|---|---|---|---|---|---|---|
| Ex. # | Incorp. Acid | g of Coup. | g of Acid | g of 20% NaOH | g of Pro-panol | g of Water | g of 33% A102 | % Acid Separ. | % Coup. by HPLC | Decomp. by Area % | ADRA Reac-tivity Rate (l/mole sec) | PCS Diam. (nm) | g Acid/ g Coup. |
| 4 | No Acid Control | 20 | 0 | 15 | 50 | 500 | 15 | 0 | 2.0 | None | 8650 | 40 | 0.00 |
| 5 | Lauric Acid | 18 | 2 | 15 | 50 | 500 | 15 | 0 | 1.8 | None | 8040 | 35 | 0.11 |
| 6 | Lauric Acid | 18 | 4 | 15 | 50 | 500 | 15 | ~20 | 1.6 | None | 8650 | 30 | 0.25 |
| 7 | Lauric Acid | 14 | 6 | 15 | 50 | 500 | 15 | ~40 | 1.3 | None | 8990 | 31 | 0.43 |
| 8 | Lauric Acid | 12 | 8 | 15 | 50 | 500 | 15 | ~60 | 1.2 | None | 7900 | 41 | 0.67 |
| 9 | Oleic Acid | 18 | 2 | 15 | 50 | 500 | 15 | 0 | 1.9 | None | 5910 | 48 | 0.11 |
| 10 | Oleic Acid | 16 | 4 | 15 | 50 | 500 | 15 | 0 | 1.7 | None | 3570 | 48 | 0.25 |
| 11 | Oleic Acid | 14 | 6 | 15 | 50 | 500 | 15 | 0 | 1.4 | None | 2740 | 38 | 0.43 |
| 12 | Oleic Acid | 12 | 8 | 15 | 50 | 500 | 15 | 0 | 1.2 | None | 2900 | 42 | 0.67 |
| 13 | Linoleic Acid | 18 | 2 | 15 | 50 | 500 | 15 | 0 | 1.7 | None | 6290 | 34 | 0.11 |
| 14 | Linoleic Acid | 16 | 4 | 15 | 50 | 500 | 15 | 0 | 1.6 | None | 3230 | 38 | 0.25 |
| 15 | Linoleic Acid | 14 | 6 | 15 | 50 | 500 | 15 | 0 | 1.4 | None | 2590 | 27 | 0.43 |
| 16 | Linoleic | 12 | 8 | 15 | 50 | 500 | 15 | 0 | 1.3 | None | 2600 | 42 | 0.67 |

TABLE B-continued

| Acid Coprecipitated Dispersions Prepared With Yellow Image Coupler C-1 | | | | | | | | | | | | | |
|---|---|---|---|---|---|---|---|---|---|---|---|---|---|
| | | Coupler Solution | | | | Surfactant Solution | | Analysis Results | | | | | |
| Ex. # | Incorp. Acid | g of Coup. | g of Acid | g of 20% NaOH | g of Pro-panol | g of Water | g of 33% A102 | % Acid Separ. | % Coup. by HPLC | Decomp. by Area % | ADRA Reac-tivity Rate (l/mole sec) | PCS Diam. (nm) | g Acid/ g Coup. |
| | Acid | | | | | | | | | | | | |

Acid Separation: Estimated gravimetrically by filtration of the dispersion and oven drying of the precipitate
HPLC: High Pressure Liquid Chromatogrpahy
Decomposition: Determined as area percent of the HPLC curves

EXAMPLES 17-29

Coprecipitated Dispersions of Magenta Image Coupler C-10 With Lauric Acid, Oleic Acid, and Linoleic Acid These examples utilize a process and the apparatus generally schematically described in FIG. 2. The composition and the amount of components used in the various solutions are shown in Table C. The coupler in these examples is a magenta coupler C-10. The dispersions were prepared exactly in the same procedure as described in the case of Examples 4–16. Results of the physical characteristics of these dispersions are also listed in Table C below.

For comparison of the ADRA reactivities, a prior art milled dispersion of coupler C-10 was prepared (The Theory of Photographic Processes, Ed., T. H. James, 4th Ed., MacMillan, New York, 1977, page 384) with the following composition using the surfactant Alkanol XC.

9.00% Coupler C-10
4.50% Tri-m-Cresyl Phosphate
15.00% 2-(2-Putoxyethoxy)-Ethyl Acetate
6.50% Gelatin and rest water This dispersion had an average particle diameter of about 200 nm as determined by Sedimentation Field Flow Fractionation. The surfactant Alkanol XC was used at a level of 6.5% based upon the coupler weight. The ADRA reactivity rate of such a dispersion was 4450 l/(mole sec). Therefore, it seems in comparison with Table C that the no-acid precipitated dispersion of coupler C-10 at a particle diameter of 55 nm (PCS) gave a very much larger ADRA reactivity rate of 18500 l/(mole sec). In other words, the no-acid precipitated dispersion of coupler C-10 is extremely reactive compared to a conventional milled dispersion. It is also observed that coprecipitation with either lauric, oleic, or linoleic acids produced dispersion that are in all cases not more active compared to the no-acid control precipitated dispersion of Example 4. Therefore, it is concluded from this observation that the coprecipitation with acids for the case of a highly active precipitated dispersion does not enhance the reactivity of the coupler dispersion. It is also observed that lauric acid which is a solid at room temperature, upon coprecipitation shows extensive phase separation (It is estimated from the dry weight of the precipitate. See Table C) for acid incorporation levels. Therefore, it is clear that solid acids (such as lauric acids) are not the preferred coprecipitation acids of this invention. Also, as pointed out above, couplers that produce, without the liquid carboxylates, highly active precipitated dispersions are not the preferred couplers of this invention.

TABLE C

| Acid Coprecipitated Dispersions Prepared With Magenta Coupler C-10 | | | | | | | | | | | | | |
|---|---|---|---|---|---|---|---|---|---|---|---|---|---|
| | | Coupler Solution | | | | Surfactant Solution | | Analysis Results | | | | | |
| Ex. # | Incorp. Acid | g of Coup. | g of Acid | g of 20% NaOH | g of Pro-panol | g of Water | g of 33% A102 | % Acid Separ. | % Coup. by HPLC | Decomp. by Area % | ADRA Reac-tivity Rate (l/mole sec) | PCS Diam. (nm) | g Acid/ g Coup. |
| 17 | No Acid Control | 20 | 0 | 15 | 50 | 500 | 15 | 0 | 1.8 | None | 18500 | 55 | 0.00 |
| 18 | Lauric Acid | 18 | 2 | 15 | 50 | 500 | 15 | ~10 | 1.5 | None | 18600 | 60 | 0.11 |
| 19 | Lauric Acid | 18 | 4 | 15 | 50 | 500 | 15 | ~20 | 1.3 | None | 18900 | 59 | 0.25 |
| 20 | Lauric Acid | 14 | 6 | 15 | 50 | 500 | 15 | ~40 | 1.2 | None | 20900 | 55 | 0.43 |
| 21 | Lauric Acid | 12 | 8 | 15 | 50 | 500 | 15 | ~60 | 1.0 | None | 20600 | 56 | 0.67 |
| 22 | Oleic Acid | 18 | 2 | 15 | 50 | 500 | 15 | 0 | 1.5 | None | 16700 | 61 | 0.11 |
| 23 | Oleic Acid | 16 | 4 | 15 | 50 | 500 | 15 | 0 | 1.2 | None | 14900 | 63 | 0.25 |
| 24 | Oleic Acid | 14 | 6 | 15 | 50 | 500 | 15 | 0 | 1.0 | None | 29500 | 65 | 0.43 |
| 25 | Oleic Acid | 12 | 8 | 15 | 50 | 500 | 15 | 0 | 0.9 | None | 29200 | 67 | 0.67 |
| 26 | Linoleic Acid | 18 | 2 | 15 | 50 | 500 | 15 | 0 | 1.4 | None | 15900 | 59 | 0.11 |
| 27 | Linoleic Acid | 16 | 4 | 15 | 50 | 500 | 15 | 0 | 1.2 | None | 13200 | 61 | 0.25 |
| 28 | Linoleic | 14 | 6 | 15 | 50 | 500 | 15 | 0 | 1.0 | None | 13600 | 62 | 0.43 |

TABLE C-continued

| Acid Coprecipitated Dispersions Prepared With Magenta Coupler C-10 | | | | | | | | | | | | | |
|---|---|---|---|---|---|---|---|---|---|---|---|---|---|
| | | Coupler Solution | | | | Surfactant Solution | | Analysis Results | | | | | |
| Ex. # | Incorp. Acid | g of Coup. | g of Acid | g of 20% NaOH | g of Pro-panol | g of Water | g of 33% A102 | % Acid Separ. | % Coup. by HPLC | Decomp. by Area % | ADRA Reac-tivity Rate (l/mole sec) | PCS Diam. (nm) | g Acid/ g Coup. |
| 29 | Acid Linoleic Acid | 12 | 8 | 15 | 50 | 500 | 15 | 0 | 0.8 | None | 20353 | 61 | 0.67 |

EXAMPLES 30–42

Coprecipitated Dispersions of Yellow Colored Magenta Coupler C-4 With Lauric Acid, Oleic Acid, and Linoleic Acid These examples utilize a process and apparatus generally schematically described in FIG. 2. The composition and the amounts used in the various solutions are shown in Table D. The coupler in this example is a yellow colored magenta coupler C-4.

These dispersions were prepared exactly in the same procedure as described in the cases of Examples 4–16. Results of the physical characteristics of these dispersions are also listed in Table D.

For comparison of ADRA reactivity, a prior art milled dispersion of coupler C-4 was prepared (The Theory of Photographic Processes, Ed. T. H. James, 4th Ed., MacMillan, New York, 1977, page 384) with the following composition, using the surfactant Alkanol XC:

3.50% Coupler C-4
7.00% Tri-m-Cresyl Phosphate
5.20% 2-(2-Butoxyethoxy)-Ethyl Acetate
6.14% Gelatin and rest water This dispersion had an average particle diameter of about 200 nm as determined by Sedimentation Field Flow Fractionation. The surfactant Alkanol XC was used at a level of 6.4% based upon the weight of the coupler. The ADRA reactivity rate of this dispersion was 17000 l/(mole sec). Therefore, unlike the case of coupler C-1 and C-10, it seems in comparison with Table D that the no-acid precipitated dispersion of coupler C-4 at a particle diameter of 120 nm (PCS) gave a much smaller ADRA reactivity rate of 11400 l/(mole sec). In other words, the no-acid precipitated dispersion of coupler C-4 is much less reactive compared to a conventional milled dispersion. Therefore, an invention is necessary to produce a precipitated dispersion of coupler C-4 that is equally or more reactive than its conventional milled analog. It is also observed in Table D that lauric acid, which is a solid carboxylic acid, underwent phase separation and lowering of activity at a larger degree of coprecipitation. Therefore, coprecipitation of solid acids like lauric acid is not preferred for this invention. It is, however, clear from Table D that coprecipitation of liquid acids, such as oleic and linoleic acids, enhance the ADRA reactivities of otherwise inactive precipitated dispersion of coupler C-4. It is also noted that the enhancement of the ADRA reactivity of the oleic and linoleic acid (which are liquid acids) coprecipitated dispersions of coupler C-4 increases with the increase of the incorporation amount of these acids. Therefore, such liquid acids are preferred compounds for this invention.

TABLE D

| Acid Coprecipitated Dispersions Prepared With Yellow Colored Magenta Coupler C-4 | | | | | | | | | | | | | |
|---|---|---|---|---|---|---|---|---|---|---|---|---|---|
| | | Coupler Solution | | | | Surfactant Solution | | Analysis Results | | | | | |
| Ex. # | Incorp. Acid | g of Coup. | g of Acid | g of 20% NaOH | g of Pro-panol | g of Water | g of 33% AlO2 | % Acid Separ. | % Coup. by HPLC | Decomp. by Area % | ADRA Reactivity Rate (l/mole sec) | PCS Diam. (nm) | g Acid/ g Coup. |
| 30 | No Acid Control | 20 | 0 | 15 | 50 | 500 | 15 | 0 | 1.9 | None | 11400 | 120 | 0.00 |
| 31 | Lauric Acid | 18 | 2 | 15 | 50 | 500 | 15 | 0 | 1.5 | None | 15100 | 121 | 0.11 |
| 32 | Lauric Acid | 18 | 4 | 15 | 50 | 500 | 15 | ~20 | 1.3 | None | 13100 | 109 | 0.25 |
| 33 | Lauric Acid | 14 | 6 | 15 | 50 | 500 | 15 | ~40 | 0.8 | None | 7900 | 88 | 0.43 |
| 34 | Lauric Acid | 12 | 8 | 15 | 50 | 500 | 15 | ~60 | 0.7 | None | 5500 | 88 | 0.67 |
| 35 | Oleic Acid | 18 | 2 | 15 | 50 | 500 | 15 | 0 | 1.5 | None | 19900 | 138 | 0.11 |
| 36 | Oleic Acid | 16 | 4 | 15 | 50 | 500 | 15 | 0 | 1.3 | None | 27000 | 98 | 0.25 |
| 37 | Oleic Acid | 14 | 6 | 15 | 50 | 500 | 15 | 0 | 1.3 | None | 26100 | 121 | 0.43 |
| 38 | Oleic Acid | 12 | 8 | 15 | 50 | 500 | 15 | 0 | 1.2 | None | 37600 | 107 | 0.67 |
| 39 | Linoleic Acid | 18 | 2 | 15 | 50 | 500 | 15 | 0 | 1.5 | None | 17500 | 89 | 0.11 |
| 40 | Linoleic Acid | 16 | 4 | 15 | 50 | 500 | 15 | 0 | 1.3 | None | 26700 | 64 | 0.25 |
| 41 | Linoleic Acid | 14 | 6 | 15 | 50 | 500 | 15 | 0 | 1.2 | None | 29600 | 126 | 0.43 |
| 42 | Linoleic | 12 | 8 | 15 | 50 | 500 | 15 | 0 | 0.8 | None | 63300 | 134 | 0.67 |

TABLE D-continued

| Acid Coprecipitated Dispersions Prepared With Yellow Colored Magenta Coupler C-4 | | | | | | | | | | | | | |
|---|---|---|---|---|---|---|---|---|---|---|---|---|---|
| | | Coupler Solution | | | | Surfactant Solution | | Analysis Results | | | | | |
| Ex. # | Incorp. Acid | g of Coup. | g of Acid | g of 20% NaOH | g of Pro-panol | g of Water | g of 33% AlO2 | % Acid Separ. | % Coup. by HPLC | Decomp. by Area % | ADRA Reactivity Rate (l/mole sec) | PCS Diam. (nm) | g Acid/ g Coup. |
| | Acid | | | | | | | | | | | | |

EXAMPLES 43-55

Coprecipitated Dispersions of Magenta Development Inhibitor Release (DIR) Coupler C-3 With Lauric Acid, Oleic Acid, and Linoleic Acid These examples utilize a process and apparatus generally schematically described in FIG. 2. The composition and amounts used in the various solutions are shown in Table E. The coupler in this example is a magenta DIR coupler C-3.

These dispersions were prepared exactly in the same procedures as described in the cases of Examples 4-16. Results of the physical characteristics of these dispersions are also listed in Table E.

For comparison of ADRA reactivity, a prior art milled dispersion of coupler C-3 was prepared with the following composition, using the surfactant Alkanol XC:

2.20% Coupler C-3
4.41% Tri-m-Cresyl Phosphate
6.62% Tri-Ethyl Phosphate
8.00% Gelatin and rest water This dispersion had an average particle diameter of about 200 nm as determined by Sedimentation Field Flow Fractionation. The surfactant Alkanol XC was used at a level of 6.0% based upon the weight of the coupler. The ADRA reactivity rate of this coupler dispersion was 7300 l/(mole sec). Therefore, unlike the case of coupler C-1 and C-10 and like the case of coupler C-4, it seems in comparison with Table E that the no-acid precipitated dispersion of coupler C-3 at a particle diameter of 188 nm (PCS) gave a much smaller ADRA reactivity rate of 713 l/(mole sec). In other words, the no-acid precipitated dispersion of coupler C-3 is much less reactive compared to a conventional milled dispersion. Therefore, an invention is necessary to produce a precipitated dispersion of coupler C-3 that is equally or more reactive than its conventional analog. It is also observed in Table E that lauric acid, which is a solid, produced undesirable phase separation in most of the formulations. Therefore, coprecipitation of solid acids like lauric acid is not preferred for this invention. It is, however, clear from Table E that coprecipitation of liquid acids, such as oleic and linoleic acids, enhance the ADRA reactivities of the otherwise precipitated dispersions of coupler C-3. It is also noted that the enhancement of the ADRA reactivity of the oleic and linoleic acid coprecipitated dispersions of coupler C-3 increases with the increase of the amount of the incorporated acids. Therefore, such liquid acids are preferred compounds for this invention.

TABLE E

| Acid Coprecipitated Dispersion Prepared With Magenta DIR Coupler C-3 | | | | | | | | | | | | | |
|---|---|---|---|---|---|---|---|---|---|---|---|---|---|
| | | Coupler Solution | | | | Surfactant Solution | | Analysis Results | | | | | |
| Ex. # | Incorp. Acid | g of Coup. | g of Acid | g of 20% NaOH | g of Pro-panol | g of Water | g of 33% AlO2 | % Acid Separ. | % Coup. by HPLC | Decomp. by Area % | ADRA Reactivity Rate (l/mole sec) | PCS Diam. (nm) | g Acid/ g Coup. |
| 43 | No Acid Control | 20 | 0 | 15 | 50 | 500 | 15 | 0 | 2.0 | None | 713 | 188 | 0.00 |
| 44 | Lauric Acid | 18 | 2 | 15 | 50 | 500 | 15 | ~10 | 1.4 | None | 735 | 177 | 0.11 |
| 45 | Lauric Acid | 18 | 4 | 15 | 50 | 500 | 15 | ~20 | 1.4 | None | 899 | 165 | 0.25 |
| 46 | Lauric Acid | 14 | 6 | 15 | 50 | 500 | 15 | ~40 | 1.0 | None | 1320 | 125 | 0.43 |
| 47 | Lauric Acid | 12 | 8 | 15 | 50 | 500 | 15 | ~60 | 1.1 | None | 1340 | 188 | 0.67 |
| 48 | Oleic Acid | 18 | 2 | 15 | 50 | 500 | 15 | 0 | 1.5 | None | 1390 | 154 | 0.11 |
| 49 | Oleic Acid | 16 | 4 | 15 | 50 | 500 | 15 | 0 | 1.3 | None | 2190 | 168 | 0.25 |
| 50 | Oleic Acid | 14 | 6 | 15 | 50 | 500 | 15 | 0 | 1.0 | None | 4090 | 123 | 0.43 |
| 51 | Oleic Acid | 12 | 8 | 15 | 50 | 500 | 15 | 0 | 0.9 | None | 6610 | 125 | 0.67 |
| 52 | Linoleic Acid | 18 | 2 | 15 | 50 | 500 | 15 | 0 | 1.3 | None | 502 | 165 | 0.11 |
| 53 | Linoleic Acid | 16 | 4 | 15 | 50 | 500 | 15 | 0 | 1.0 | None | 1440 | 160 | 0.25 |
| 54 | Linoleic Acid | 14 | 6 | 15 | 50 | 500 | 15 | 0 | 0.9 | None | 3350 | 120 | 0.43 |
| 55 | Linoleic Acid | 12 | 8 | 15 | 50 | 500 | 15 | 0 | 0.6 | None | 6570 | 120 | 0.67 |

EXAMPLE 56

Photographic Evaluation of the Oleic Acid Copercipitated Dispersion of the DIR Coupler C-3 of This Invention (Example 51) Against its Comparison (Example 2)

The comparison dispersion of Example 2 and the dispersion of the invention Example 51 were evaluated in a coating format as described earlier with the precipitated image coupler dispersion of coupler C-7 of Example 1. The description of the various coatings are indicated in Table F. The coating melts were prepared just prior to coating in order to minimize transport of the liquid carboxylic acid to the image coupler dispersion. The coatings were given a stepwise exposure with green light and the processed by the C41 processing as described in British Journal of Photography Annual of 1988, page 196 to 198. The formed magenta images were then read in green light which gave the sensitometric curves shown in FIGS. 5A and 5B. The sensitometric results of coatings 1 through 5 are also listed in Table F.

Figure 5A:
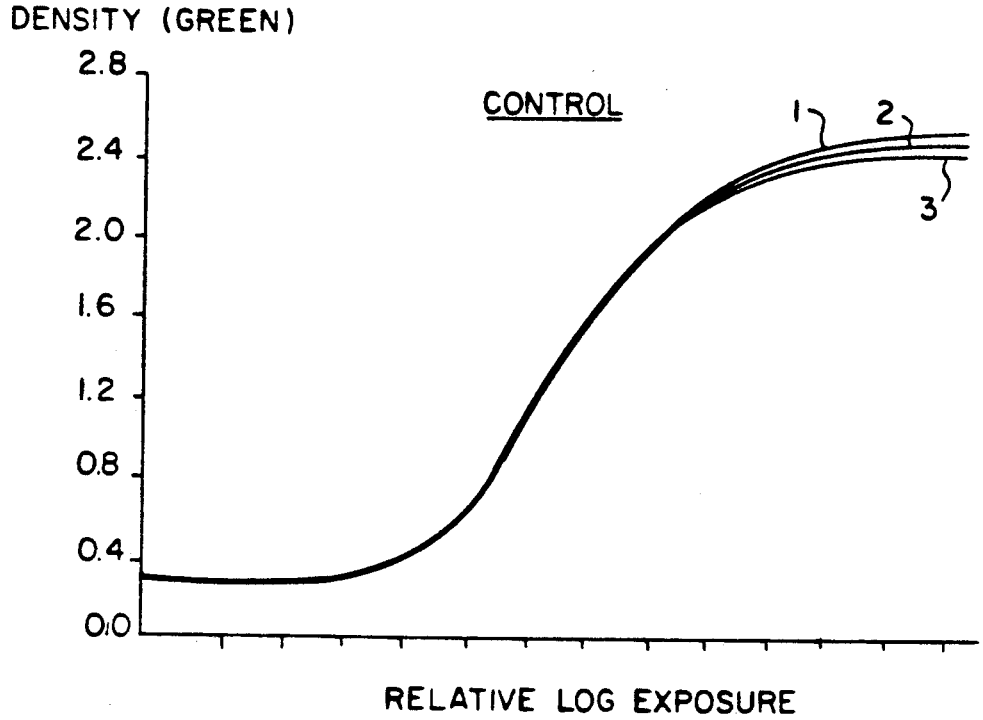
FIGS. 5A, 5B, 6A, and 6B are sensitometric curves comparing the carboxylic acid containing invention dispersions with control dispersions.

FIG. 5A is a sensitometric curve for control coatings 1, 2, and 3.

| | |
|---|---|
| Coating 1 of Example 56 | Ag → 1.614 g/m$^2$<br>No carboxylic acid precipitated image coupler<br>C-7 (Dispersion of Example 1)<br>C-7 → 0.646 g/m$^2$ |
| Coating 2 of Example 56 | Ag → 1.614 g/m$^2$<br>No carboxylic acid precipitated image coupler<br>C-7 (Dispersion of Example 1)<br>C-7 → 0.646 g/m$^2$<br>No carboxylic acid precipitated DIR coupler<br>C-3 (Dispersion of Example 2)<br>C-3 → 0.0323 g/m$^2$ |
| Coating 3 of Example 56 | Ag → 1.614 g/m$^2$<br>No carboxylic acid precipitated image coupler<br>C-7 (Dispersion of Example 1)<br>C-7 → 0.646 g/m$^2$<br>No carboxylic acid precipitated DIR coupler<br>C-3 (Dispersion of Example 2)<br>C-3 → 0.0646 g/m$^2$ |

Figure 5B:
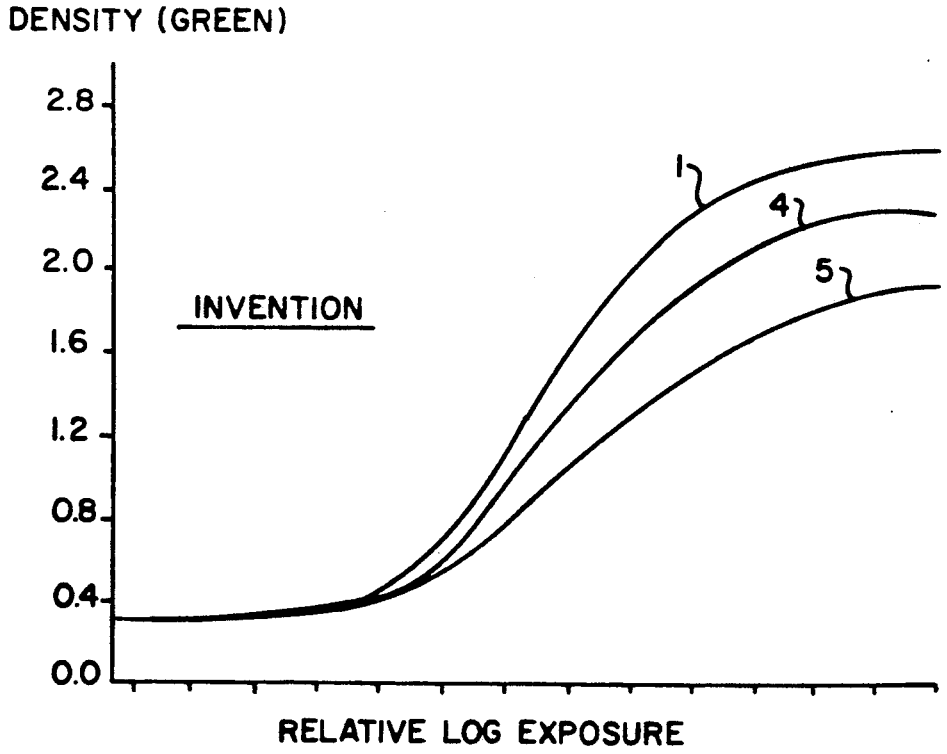

FIG. 5B is a sensitometric curve for control coatings 1 and 2, and coating 3 (invention).

| | |
|---|---|
| Coating 1 | Ag → 1.614 g/m$^2$ |

-continued

| | |
|---|---|
| of Example 56 | No carboxylic acid precipitated image coupler<br>C-7 (Dispersion of Example 1)<br>C-7 → 0.646 g/m$^2$ |
| Coating 4 of Example 56 | Ag → 1.614 g/m$^2$<br>No carboxylic acid precipitated image coupler<br>C-7 (Dispersion of Example 1)<br>C-7 → 0.646 g/m$^2$<br>0.67 x oleic acid coprecipitated DIR coupler C-3 (Dispersion of Example 51)<br>C-3 → 0.0323 g/m$^2$ |
| Coating 5 of Example 56 | Ag → 1.614 g/m$^2$<br>No carboxylic acid precipitated image coupler<br>C-7 (Dispersion of Example 1)<br>C-7 → 0.646 g/m$^2$<br>0.67 x oleic acid coprecipitated DIR coupler C-3 (Dispersion of Example 51)<br>C-3 → 0.0646 g/m$^2$ |

FIG. 5A shows that when a precipitated dispersion of coupler C-7, containing no carboxylic acid, is coated with a similar precipitated, no carboxylic aciddispersion of DIR coupler C-3 at levels 0 (coating #1), 0.0323 g/m$^2$ (coating #2) and 0.0646 g/m$^2$ the sensitometric curves are virtually identical with no change in the contrast of this image. This indicates that even through the no carboxylic acid precipitated dispersion of the image coupler of C-7 was very active, the similar no carboxylic acid precipitated dispersion of the DIR coupler of C-3 was extremely inactive compared to the similar experiment performed with the precipitated DIR coupler dispersion containing a coprecipitated carboxylic acid. According to the method of the invention, the results in FIG. 5B and Table F show that the increased laydown of the DIR coupler, the contrast and the $D_{max}$ of the recorded image decreased progressively. This clearly demonstrates that the oleic acid containing precipitated dispersion of the invention is definitely much more active than that of the comparison where no addenda was incorporated into the precipitated dispersion of C-3. It is also to be noted in Table F that in spite of the large particle size of the oleic acid containing DIR dispersion of C-3, it has about five times larger ADRA reactivity rate compared to that of the no carboxylic acid containing precipitated disperison, indicating again that the coprecipitation of the liquid carboxylic acid into the dispersion particles of C-3 in the manner of this invention caused them to be highly reactive.

TABLE F

Summary of Results of Coatings 1 Through 5 of Example 56

| Ctg. # | Image Coupler Laydown (g/m$^2$) | DIR Coupler Laydown (g/m$^2$) | Average Particle Diameter of DIR Coupler Dispersion | Solution ADRA Reactivity Rate of DIR Dispersion l/(mole sec) | $D_{max}$ of Green Image | Contrast of Green Image | Comments |
|---|---|---|---|---|---|---|---|
| #1 Control | Precipitated no carboxylic acid dispersion of Example 1 Coverage 0.646 g/m$^2$ | None | — | — | 2.52 | 1.57 | Precipitated control coupler dispersion of Cplr. C-7 is very active by itself w/o any incorp. carboxylic acid. |
| #2 Control | Same as in Coating #1 | Precipitated no carboxylic acid dispersion of Coupler 3 of Example 2 Coverage | 39 nm | 1390 | 2.49 | 1.57 | DIR coupler is precipitated no carboxylic dispersion. DIR coupler had no effect on $D_{max}$ and contrast of negative image indicating very poor re- |

TABLE F-continued

Summary of Results of Coatings 1 Through 5 of Example 56

| Ctg. # | Image Coupler Laydown (g/m²) | DIR Coupler Laydown (g/m²) | Average Particle Diameter of DIR Coupler Dispersion | Solution ADRA Reactivity Rate of DIR Dispersion 1/(mole sec) | $D_{max}$ of Green Image | Contrast of Green Image | Comments |
|---|---|---|---|---|---|---|---|
| | | 0.0323 g/m² | | | | | activity of DIR coupler dispersion. |
| #3 Control | Same as in Coating #1 | Precipitated no carboxylic acid dispersion of Coupler 3 of Example 2 Coverage 0.646 g/m² | 39 nm | 1390 | 2.44 | 1.57 | DIR coupler is precipitated no carboxylic acid dispersion. DIR coupler at 2X level compared to Coating #2 had no effect on $D_{max}$ and contrast of negative image indicating very poor reactivity of DIR coupler dispersion. |
| #4 Invention | Same as in Coating #1 | Precipitated 0.67X oleic acid dispersion of Coupler C-3 of Example 51 Coverage 0.0323 g/m² | 125 nm | 6610 | 2.26 | 1.33 | DIR coupler dispersion is coprecipitated with 0.67X oleic acid. Coupler in dispersion of invention is active indicated by increased ADRA rate and decrease of $D_{max}$ and contrast of magenta image. |
| #5 Invention | Same as in Coating #1 | Precipitated 0.67X oleic acid S-13 dispersion of Coupler C-3 of Example 51 Coverage 0.0646 g/m² | 125 nm | 6610 | 1.87 | 0.93 | DIR coupler dispersion is coprecipitated with 0.67X oleic acid. Coupler in dispersion of invention is active indicated by increased ADRA rate and decrease of $D_{max}$ and contrast of magenta image. |

EXAMPLE 57

Photographic Evaluation of the Linoleic Acid Coprecipitated Dispersion of the Yellow Colored Magenta Coupler C-4 (Example 42) Against its Comparison Where No Coupler Solvent was Incorporated (Example 3)

Yellow colored magenta coupler C-4 is a color correction coupler that is usually incorporated in the magenta layer of color negative products along with the image coupler and a DIR coupler.

The comparison dispersion of coupler C-4 of Example 3 and the linoleic acid coprecipitated dispersion of Example 42 were evaluated in a coating format described earlier. The description of the two coatings are shown in Table G. The yellow colored magenta coupler dispersion of C-4 was coated at 0.646 g/m² with the indicated green sensitized emulsion to evaluated their comparative reactivities. The coatings were given a stepwise exposure with green light and then processed by the C-41 processing as described in British Journal of Photography Annual of 1988, pages 196 to 198 for two minutes. The formed magenta images were then read using green and blue lights which gave the sensitometric results of coatings 1 and 2 are listed in Table G and shown in FIGS. 6A and 6B respectively.

Figure 6A:
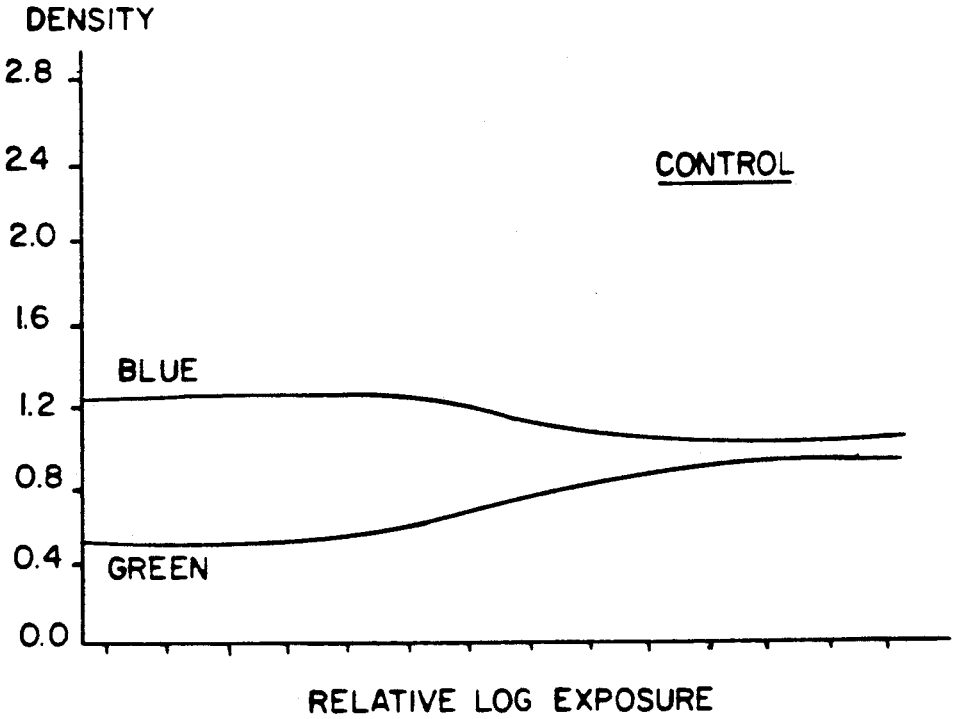

FIG. 6A is a sensitometric curve for coating 1 (control) of Example 57.

Ag→1.614 g/m²

No carboxylic acid precipitated yellow colored magenta coupler (Dispersion of Example 3) C-4→0.646 g/m².

Figure 6B:
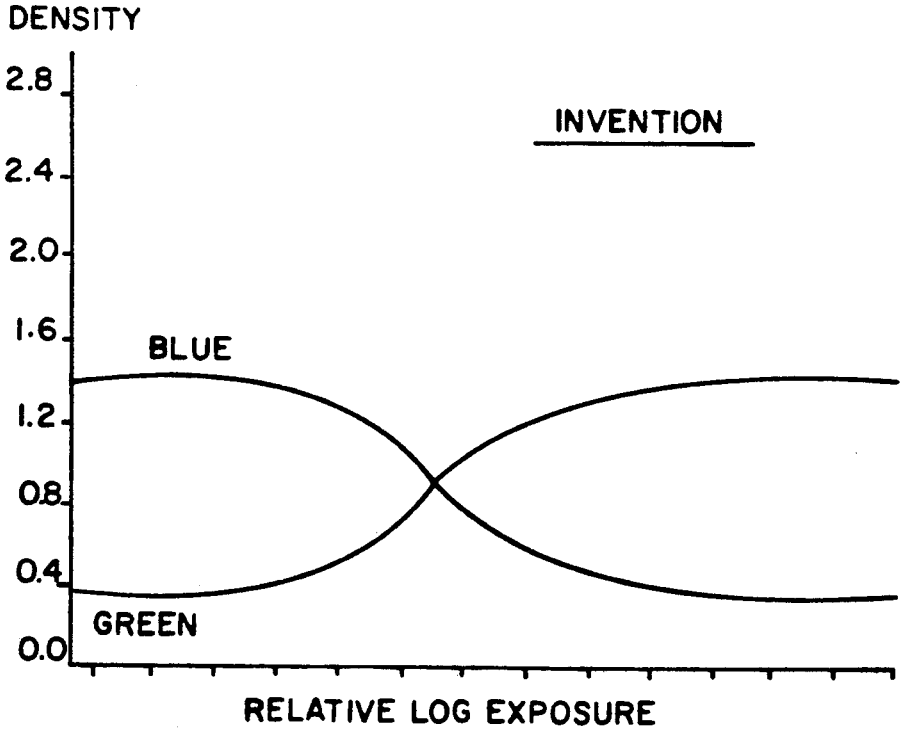

FIG. 6B is a sensitometric curve for coating 2 (invention) of Example 57.

Ag→1.614 g/m²

0.67×S-13 linoleic acid coprecipitated yellow colored magenta coupler (Dispersion of Example 42) C-7→0.646 g/m².

In the sensitometric curves of FIGS. 6A and 6B, it is seen with the yellow colored magenta coupler that as exposure is increased magenta dye is formed imagewise and yellow dye is at the same time consumed imagewise. It is also seen that the linoleic acid coprecipitated dispersion of thie invention (FIG. 6B) showed greater $D_{max}$, higher contrast, and larger ADRA reactivity (Table G) compared to the no addenda precipitated control of FIG. 6A, indicating the usefulness and efficacy of this invention.

TABLE G

Summary of Results of Coatings 1 and 2 of Example 57

| Coating No. | Laydown of Coupler C-4 g/m² | Average Particle Diameter of the Precipitated Dispersion of of C-4 (nm) | Solution ADRA Reactivity of the Precipitated Dispersion of C-4 1/(mole/sec) | $D_{max}$ of Green Image | Contrast of Green Image | Comments |
|---|---|---|---|---|---|---|
| 1 (Control) | Precipitated no carboxylic acid dispersion of coupler C-4 coverage of | 13 nm | 18500 | 0.90 | 0.28 | Precipitated dispersions of coupler C-4 with no carboxylic acid shows very poor activity as reflected in its low ADRA reac- |

TABLE G-continued

| Coating No. | Laydown of Coupler C-4 g/m$^2$ | Summary of Results of Coatings 1 and 2 of Example 57: Average Particle Diameter of the Precipitated Dispersion of of C-4 (nm) | Solution ADRA Reactivity of the Precipitated Dispersion of C-4 l/(mole/sec) | $D_{max}$ of Green Image | Contrast of Green Image | Comments |
|---|---|---|---|---|---|---|
| | Example 3 0.646 g/m$^2$ | | | | | tivity, low $D_{max}$ and low contrast. |
| 2 (Invention) | Coprecipitated with 0.67 linoleic dispersion of coupler C-4 of Example 42 coverage 0.646 g/m$^2$ | 134 nm | 63300 | 1.43 | 1.23 | Coprecipitated with linoleic acid dispersion of coupler C-4 shows very good activity as reflected in high ADRA reactivity, high $D_{max}$ and high contrast. |

The invention has been described in detail with particular reference to preferred embodiments thereof, but it will be understood that variations and modifications can be effected within the spirit and scope of the invention.

We claim:

1. A method of preparing coprecipitated aqueous dispersions of a photographic material comprising
   providing a first flow comprising a solution of a surfactant in water,
   providing a second flow comprising an auxiliary water miscible volatile solvent, base, water, photographic material, and liquid carboxylic acid,
   mixing said first and said second flows, and
   immediately neutralizing the mixed flows to precipitate particles of said photographic material with said carboxylic acid incorporated in the particles forming a fine particle colloidal dispersion of said photographic material.

2. The method of claim 1 wherein immediately after mixing, the mixture of the first flow, and second flow is adjusted to a pH of about 6.0 by the addition of organic acids to form stable particles.

3. The method of claim 2 wherein said base ionizable compound comprises liquid carboxylic acid.

4. The method of claim 3 wherein said photographic material comprises

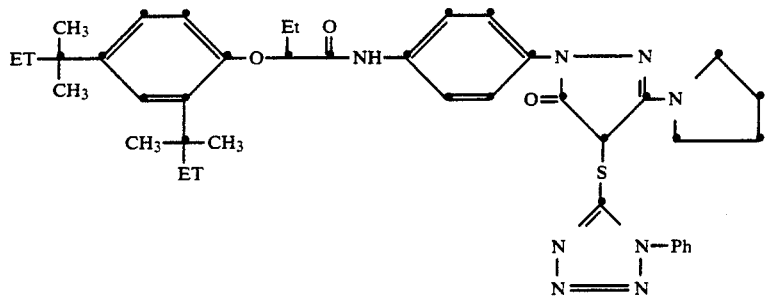

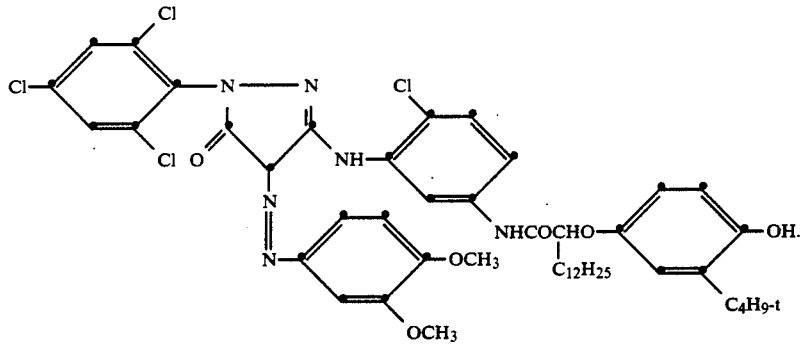

5. The method of claim 1 wherein said mixing of said first flow and said second flow, and said neturalizing take place simultaneously.

6. The method of claim 1 wherein said base comprises sodium hydroxide.

7. The method of claim 1 wherein the particles in said colloidal dispersion are of a size between about 5 and about 300 nm.

8. The method of claim 1 wherein after said neutralizing the said colloidal dispersion is immediately processed to remove said water miscible auxiliary solvent and salt by products of neutralization to prepare the particles for use in forming a photographic element.

9. The method of claim 2 wherein during said neutralization of pH is adjusted to about 6.0 at a location downstream from the initial mixing of said first and said second flows.

10. The method of claim 2 wherein said neutralization to a pH of about 6.0 utilizes acetic acid.

11. The method of claim 2 wherein said neutralization to a pH of about 6.0 utilizes propionic acid.

12. The method of claim 1 wherein said immediately neutralizing is with low mechanical shear and high fluid shear.

13. The method of claim 1 wherein said immediately neutralizing takes place in less than about two minutes after said mixing.

14. The method of claim 1 wherein the method is operated in a semicontinuous manner.

15. The method of claim 1 wherein the method is performed continuously.

16. The method of claim 1 wherein said photographic material comprising at least one member selected from the group comprising couplers, UV absorbers, reducing agents, and developing agents.

17. The method of claim 3 wherein said photographic material comprises photographic coupler.

18. The method of claim 1 wherein said surfactant is base degradable.

19. The method of claim 1 wherein said surfactent is hydrolyzable.

20. Thie method of claim 3 wherein said first flow, said second flow, and a neutralizing acid solution are simultaneously mixed to precipitate and immediately neutralize said photographic material in a fine particle colloidal dispersion at about pH 6.0.

21. The method of claim 1 wherein said water miscible, volatile solvent comprises propanol, methanol, cyclohexanone, ethyl acetate, or mixtures thereof.

22. The method of claim 3 wherein the said liquid carboxylic acid comprises at least one of Oleic Acid: ($CH_3$—$(CH_2)_7$—CH=CH—$(CH_2)_7$—COOH), Linoleic Acid: ($CH_3$—$(CH_2)_4$—CH=CH—$CH_2$—CH=CH—$(CH_2)_7$—COOH), and Linolenic Acid: ($CH_3$—$(CH_2$—CH=CH$)_3$—$CH_2$—$(CH_2)_6$—COOH).

23. The method of claim 3 wherein said surfactant is selected from at least one of the following classes:

Class I—Surfactants with single, double, or triple $C_5$ to $C_{25}$ hydrocarbon chain terminated with one or more charged head groups and optionally provided with polymeric or oligomeric steric stabilizers comprising water soluble polymers and block oligomeric compounds comprising hydrophobic polyoxypropylene blocks (A) and hydrophilic polyoxyethylene blocks (B) joined in the manner of A-B-A, B-A-B, A-B, $(A\text{-}B)_n{\equiv}G{\equiv}(B\text{-}A)_n$, or $(B\text{-}A)_n{\equiv}G{\equiv}(A\text{-}B)_n$, where G is a connective organic moiety and n is between 1 and 3.

Class II—Surfactants comprising between 6 to 22 carbon atom hydrophobic tail with one or more attached hydrophilic chains comprising at least four oxyethylene and/or glycidyl ether groups that may or may not be terminated with a negative charge such as a sulfate group, and.

Class III—Sugar surfactants, comprising between one and three 6 to 22 carbon atom hydrophobic tail with one or more attached hydrophilic mono or oligosaccharidic hydrophilic chains that may or may not be terminated by a negatively charged group such as a sulfate group.

* * * * *